US010968064B2

(12) United States Patent
Steck et al.

(10) Patent No.: US 10,968,064 B2
(45) Date of Patent: Apr. 6, 2021

(54) WINDING DEVICE FOR WINDING UP A RIBBON OR WEB

(71) Applicant: HERMA GmbH, Filderstadt (DE)

(72) Inventors: Manuel Steck, Filderstadt (DE); Tomislav Musa, Stuttgart (DE); Kirill Wist, Leonberg (DE); Thomas Osswald, Filderstadt (DE)

(73) Assignee: HERMA GMBH, Filderstadt (DE)

( * ) Notice: Subject to any disclaimer, the term of this patent is extended or adjusted under 35 U.S.C. 154(b) by 109 days.

(21) Appl. No.: 16/313,132

(22) PCT Filed: Jun. 1, 2018

(86) PCT No.: PCT/EP2018/064507
§ 371 (c)(1),
(2) Date: Dec. 25, 2018

(87) PCT Pub. No.: WO2018/234015
PCT Pub. Date: Dec. 27, 2018

(65) Prior Publication Data

US 2019/0119060 A1 Apr. 25, 2019

(30) Foreign Application Priority Data

Jun. 21, 2017 (DE) ..... 10 2017 113 731.9

(51) Int. Cl.
*B65H 23/195* (2006.01)
*B65H 18/10* (2006.01)
*B65H 23/182* (2006.01)

(52) U.S. Cl.
CPC ..... *B65H 23/1955* (2013.01); *B65H 18/10* (2013.01); *B65H 23/1825* (2013.01);
(Continued)

(58) Field of Classification Search
CPC ..... B65H 23/1955; B65H 23/1823; B65H 18/10; B65H 2301/414; B65H 2403/21;
(Continued)

(56) References Cited

U.S. PATENT DOCUMENTS 3,385,535 A * 5/1968 Dodsworth ..... G11B 15/16 242/413.8
4,871,125 A 10/1989 Haueter ..... 242/67.3
(Continued)

FOREIGN PATENT DOCUMENTS

DE 1957513 6/1970
DE 10 2005-058964 A 6/2007 ..... B65C 9/18
(Continued)

OTHER PUBLICATIONS

EPO machine translation of JP H05-60852 claims (1993), 1 page.
(Continued)

*Primary Examiner* — Michael E Gallion
(74) *Attorney, Agent, or Firm* — Caldwell Intellectual Property Law

(57) ABSTRACT

A winding device (10) for winding a web (92) onto a reel (90) has a drive shaft (20), a gear (30), a clutch shaft (63), an energy storage means (50), a clutch (60) and an output shaft (80). The gear (30) is configured, as a positive-engagement gear, to transmit a rotary movement of the drive shaft (20) to a first clutch shaft element (61) assigned to the clutch shaft (63). The clutch shaft (63) is connected via the clutch (60) with the output shaft (80) in order, selectively, to enable or prevent a transmission of torque between the clutch shaft (63) and the output shaft (80). The gear (30) has, without the energy storage means (50) having effect, a first predetermined transmission ratio (i_0) between the drive shaft (20) and the clutch shaft (63), and the energy storage
(Continued)

Figure 1:
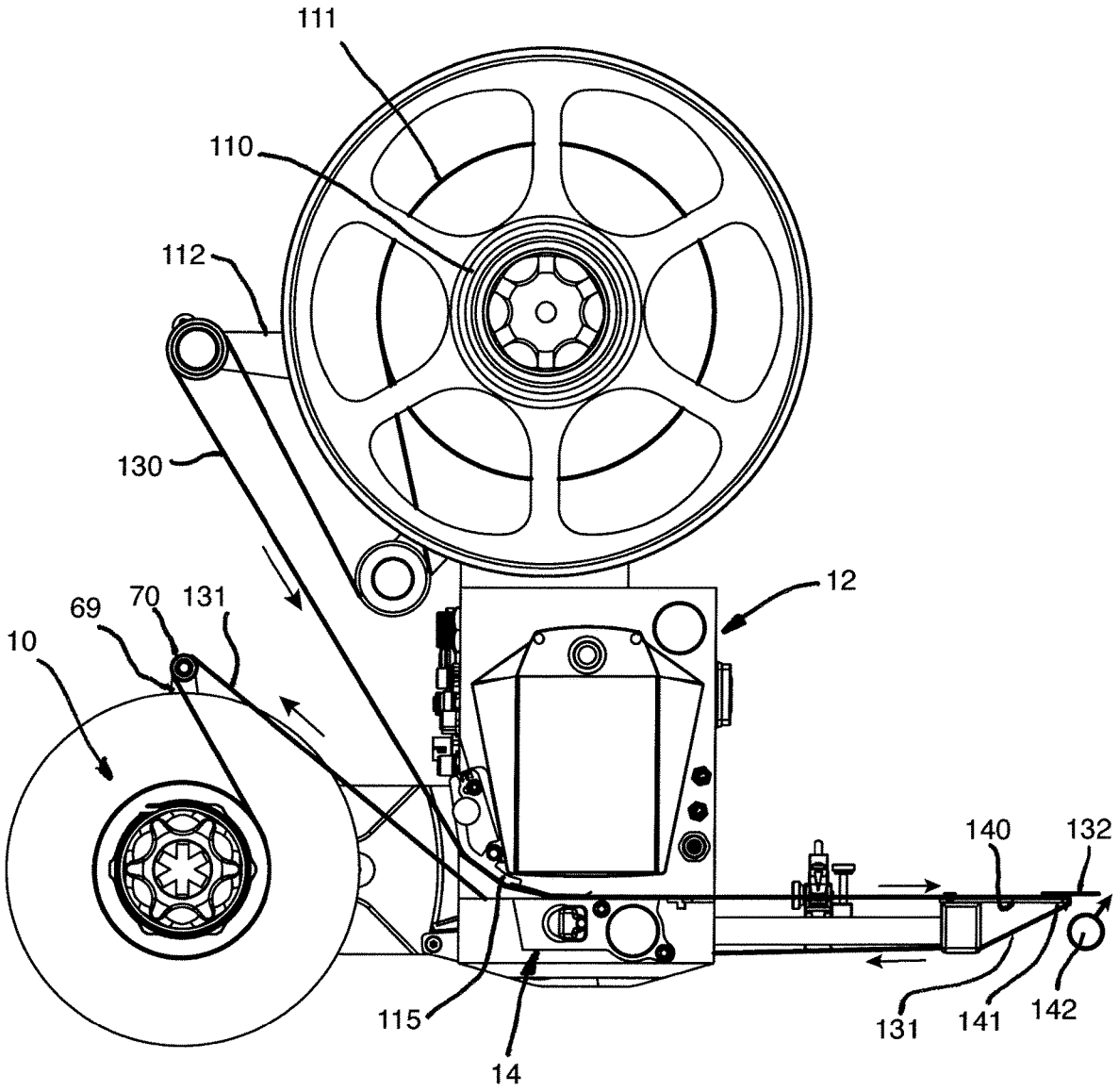

means (50) is configured to store and release rotational energy and to vary the transmission ratio.

24 Claims, 14 Drawing Sheets

(52) U.S. Cl.
CPC ..... *B65H 23/195* (2013.01); *B65H 2301/414* (2013.01); *B65H 2403/21* (2013.01); *B65H 2403/72* (2013.01); *B65H 2513/108* (2013.01); *B65H 2801/75* (2013.01)

(58) Field of Classification Search
CPC ..... B65H 2403/72; B65H 2403/946; B65H 2513/108; B65H 2801/75
See application file for complete search history.

(56) References Cited

U.S. PATENT DOCUMENTS

| | | | | |
|---|---|---|---|---|
| 6,199,614 | B1 | 3/2001 | Snyder et al. | 156/387 |
| 7,543,773 | B2 | 6/2009 | Lenkl | 242/417.3 |
| 8,012,279 | B2 | 9/2011 | Thiel et al. | 156/64 |
| 10,118,786 | B2 * | 11/2018 | Qiu | B65H 16/005 |
| 2017/0158450 | A1 * | 6/2017 | Qiu | B65H 16/005 |

FOREIGN PATENT DOCUMENTS

| | | | | |
|---|---|---|---|---|
| EP | 0036193 | A | 9/1981 | B65H 17/22 |
| EP | 0290731 | A2 | 11/1988 | G07D 9/00 |
| EP | 1 663791 | A | 7/2008 | B65C 9/42 |
| FR | 946184 | A | 5/1949 | |
| GB | 1230037 | | 4/1971 | G11B 15/43 |
| JP | H05-60852 | U | 8/1993 | B41J 15/16 |
| JP | H10-16337 | A | 1/1998 | B41J 15/00 |
| WO | WO 92-22490 | | 12/1992 | B65H 20/24 |

OTHER PUBLICATIONS

EPO machine translation of JP HO5-60852 description (1993), 6 pp.
Pat.Abs. of Japan, English abstract of JP H10-16337 (1998), 8 pp.
EPO machine translation of JP H10-16337 description (1998), 14 pp.

* cited by examiner

WINDING DEVICE FOR WINDING UP A RIBBON OR WEB

CROSS-REFERENCE

This application is a section 371 of PCT/EP2018/064,507 filed 1 Jun. 2018.

FIELD OF THE INVENTION

The invention relates to a winding device for winding up a ribbon or web, in particular a carrier web, following the dispensing of labels.

BACKGROUND

EP 1 663 791 B1 (corresponding to U.S. Pat. No. 8,012,279) shows, by way of example, the structure of a labelling device and a labelling device with unwinder and rewinder.

Labelling devices are used nowadays for increasingly wide labels and increasingly fast labelling speeds. The labels are in some cases hereby dispensed in cyclic operation, so that a speed profile for the movement of the label web is predetermined and the label web is stopped between the individual dispensing actions. This leads to powerful accelerations (positive and negative). These demanding requirements can lead to malfunctions in the rewinding device or rewinder.

SUMMARY OF THE INVENTION

It is therefore an object of the invention to provide a new winding device.

The object is achieved by equipping the winding device with a drive shaft, a positive engagement gear, a clutch shaft, an energy storage means, a clutch, and an output shaft, configuring the clutch to selectively transmit, or not transmit, torque from the drive shaft to the output shaft, at different respective transmission ratios, arranging the energy storage means to temporarily store energy from the drive shaft while simultaneously increasing the transmission ratio, relative to a first predetermined transmission ratio, and to release stored energy to the output shaft, while simultaneously decreasing the transmission ratio, relative to the first predetermined transmission ratio.

According to this, the energy storage means can temporarily store at least a part of the energy transmitted via the gear in the form of potential energy and thereby simultaneously increase the transmission ratio between the drive shaft and the clutch shaft. The stored potential energy can subsequently be released with simultaneous lowering of the transmission ratio.

The use of the positive-engagement gear makes possible a good transmission of torque. The provision of the energy storage means thereby makes it possible to reduce the slip on the clutch. This leads, on the one hand, to less wear on the clutch and to less generation of heat on the clutch, and on the other hand the risk of unsatisfactory rewinding on the winding device is reduced.

According to a preferred embodiment, the energy storage means is configured to store the potential energy in a spring element. This makes possible a good release of the energy stored in the spring element.

According to a preferred embodiment, the energy storage means is configured to enable a storage of potential energy with simultaneous lowering of the transmission ratio relative to the first predetermined transmission ratio, and then to enable a release of the stored potential energy with simultaneous increase of the transmission ratio relative to the first predetermined transmission ratio. As a result, the energy storage means can have an advantageous effect on braking of the drive shaft.

According to a preferred embodiment, the gear is configured as a gear drive. Gear drives allow the transmission of high torques.

According to a preferred embodiment, the energy storage means comprises the first clutch shaft element and a second clutch shaft element assigned to the first clutch shaft element, said second clutch shaft element being firmly connected to the clutch shaft, wherein the first clutch shaft element and the second clutch shaft element are arranged concentrically with the clutch shaft and are rotatable relative to each other, wherein at least one spring element is arranged between the first clutch shaft element and the second clutch shaft element, said spring element being configured, on a rotation of the first clutch shaft element relative to the second clutch shaft element in a first predetermined direction of rotation, at least partially to absorb potential energy in the form of spring energy, and on a relative rotation in a second direction of rotation opposite to the first direction of rotation, at least partially to release the potential energy again. This makes possible a rotary energy storage means.

According to a preferred embodiment, a first damping element is provided which is configured at least partially to dampen a rotation of the first clutch shaft element relative to the second clutch shaft element in the second direction of rotation. Such a damping element reduces the risk of a transmission of a high torque from the clutch shaft to the drive shaft.

According to a preferred embodiment, a second damping element is provided which is configured at least partially to dampen a rotation of the first clutch shaft element relative to the second clutch shaft element in the first direction of rotation. Such a damping element reduces the risk of a transmission of a high torque from the clutch shaft to the drive shaft.

According to a preferred embodiment, a first stop is provided in order to limit a rotation of the first clutch shaft element relative to the second clutch shaft element in the first direction of rotation. The provision of a stop facilitates the mounting of a damping element.

According to a preferred embodiment, the stop is arranged at least partially in the spring element in order to effect a guidance of the spring element. This means that the spring element can also be guided from within, and this improves the guidance of the spring.

According to a preferred embodiment, the gear is configured as a positive-engagement traction gear, said traction gear having a traction means, said traction means interacting with the drive shaft and with the first clutch shaft element in order to enable a transmission of torque from the drive shaft to the clutch shaft. Tests have shown that a distance between the drive shaft and the clutch shaft can readily be bridged through the traction means.

According to a preferred embodiment, the traction gear is configured as a toothed belt gear with a toothed belt as traction means, and the first clutch shaft element is configured as a belt pulley. A toothed belt gear requires less maintenance and is particularly suitable since it is only subject to a small degree of wear.

According to a preferred embodiment, the traction gear is configured as a chain gear with a chain as traction means, and the first clutch shaft element is configured as a sprocket. Chain gears can be used for very high forces; however, they usually require lubrication.

According to a preferred embodiment, the energy storage means comprises a carriage guide and a carriage, said carriage being displaceable relative to the carriage guide, wherein at least one spring element is arranged between the carriage and the carriage guide, and wherein the carriage has at least one first pulley, wherein the winding device defines a first partial path for the traction means between the drive shaft and the first clutch shaft element and a second partial path between the first clutch shaft element and the drive shaft, and wherein the first pulley is, in the first partial path, in contact with the traction means, so that a displacement of the carriage results in a shortening or lengthening of the first partial path depending on the direction of displacement, and said energy storage means is configured to enable an absorption of energy in that the first partial path is changed such that the transmission ratio is increased relative to the first predetermined transmission ratio through this change in the first partial path and potential energy is thereby stored in the spring element, and to enable a release of the stored energy in that the first partial path is changed such that the transmission ratio is lowered relative to the first predetermined transmission ratio through this change in the first partial path and the potential energy stored in the spring element is thereby released. As a result, the energy storage means can in particular be activated upon acceleration of the drive shafts.

According to a preferred embodiment, the energy storage means is configured to enable an absorption of energy in that the first partial path is changed such that the transmission ratio is lowered relative to the first predetermined transmission ratio through this change in the first partial path and potential energy is thereby stored in the spring element, and to enable a release of the stored energy in that the first partial path is changed such that the transmission ratio is increased relative to the first predetermined transmission ratio through this change in the first partial path and potential energy stored in the spring element is thereby released. As a result, the energy storage means can in particular be activated on an acceleration of the drive shafts.

According to a preferred embodiment, the carriage has a second pulley, said second pulley being, in the second partial path, in contact with the traction means in order to effect a compensation in length between the first partial path and the second partial path. This renders unnecessary additional means for length compensation.

According to a preferred embodiment, a damping element is provided at at least one end position of the carriage which is configured to dampen the movement of the carriage towards a first end position, wherein damping elements are preferably provided at both end positions of the carriage. In tests, a drive with powerful acceleration and powerful braking under extreme conditions led to a high torque on the clutch shaft being transmitted powerfully to the drive shaft in the case of a stop without damping element, and this can lead to malfunctions of the drive. This risk is reduced through the provision of the damping elements, and these have proved very advantageous.

According to a preferred embodiment, at least one end position of the carriage is defined by a stop, preferably both end positions. This prevents an overstretching of the springs, and the stops can readily be provided with a damping element.

According to a preferred embodiment, the winding device has a pendulum, said pendulum being able to assume variable pendulum positions, wherein the clutch is configured to influence the connection between the output shaft and the clutch shaft depending on the variable pendulum position. The use of a pendulum is particularly advantageous for the winding device, since the risk of a loose web is reduced.

According to a preferred embodiment, the pendulum has a web guide for guiding a web, and the pendulum position is dependent on the tension of the web. The web tension has proved to be an advantageous criterion for control in the region of the winding device.

According to a preferred embodiment, the winding device has a braking device, said braking device being configured to enable a controllable braking of the output shaft. In combination with a positive-engagement gear, such a braking device has proved advantageous for safe operation with large reels.

According to a preferred embodiment, the winding device has a pendulum, said pendulum being able to assume variable pendulum positions, wherein the braking device is configured to influence the controllable braking of the output shaft depending on the variable pendulum position. As a result, the braking device can be combined with the pendulum function, and the braking takes place in a readily reproducible manner.

According to a preferred embodiment, the winding device is configured, depending on the web tension,

- in a first range of the web tension, to keep the clutch closed,
- at the transition from the first range into a second range, said second range being assigned a higher web tension than the first range, to open the clutch, and
- at the transition from the second range into a third range, said third range being associated with a higher web tension than the second range, to activate the braking device.

Such a winding device makes safe operation possible, even with large, heavy reels and high speeds and accelerations.

According to a preferred embodiment, the labelling device has a drive for movement of a label web for the dispensing of labels and a winding device, wherein the drive is configured also to drive the drive shaft for the winding device. In this embodiment, the energy storage means is particularly advantageous, since the drive is actuated depending on the dispensing of the label web and can nonetheless be used reliably to drive the reel. Moreover, no additional drive is necessary.

BRIEF FIGURE DESCRIPTION

Further details and advantageous further developments of the invention are disclosed in the exemplary embodiments described in the following and illustrated in the drawings.

Figure 2:
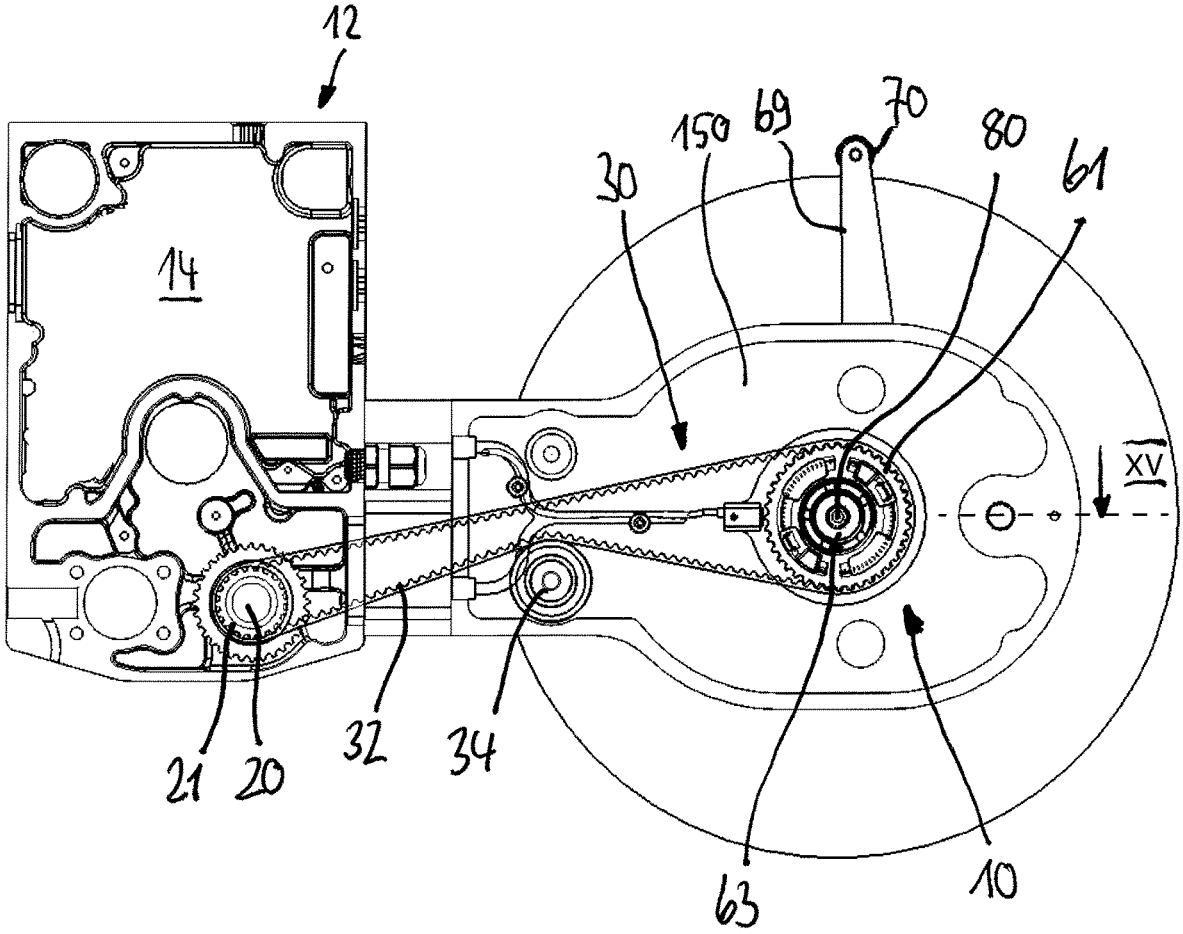
Figure 3:
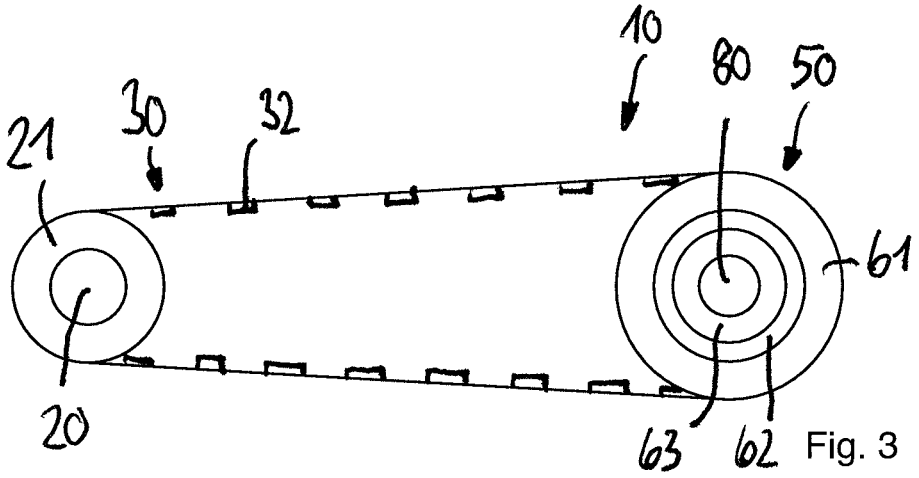
Figure 4:
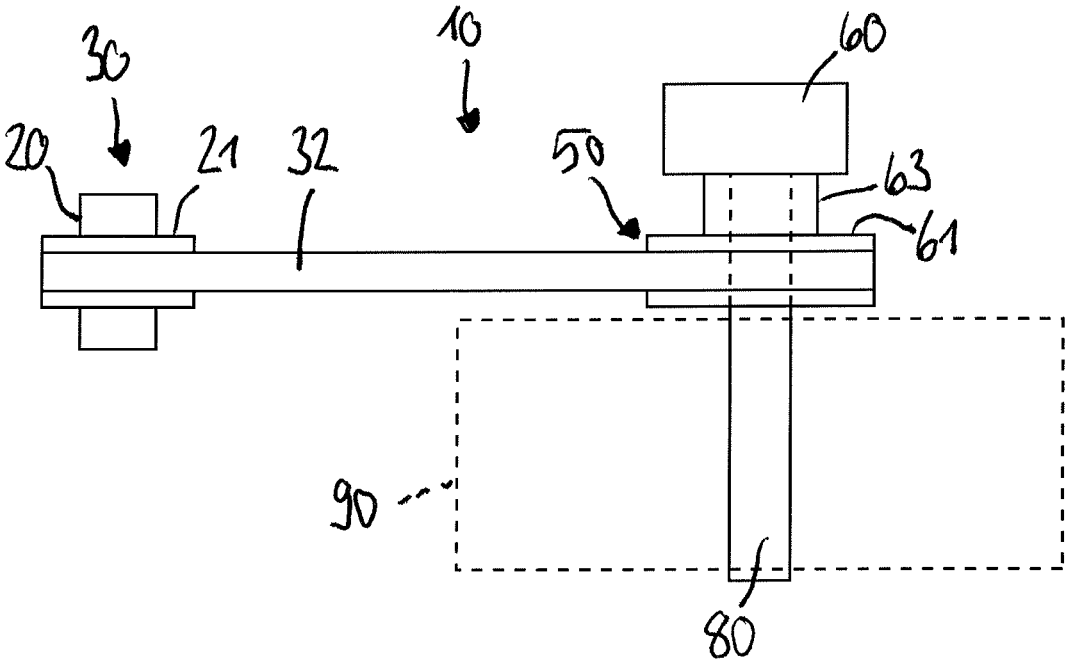
Figure 5:
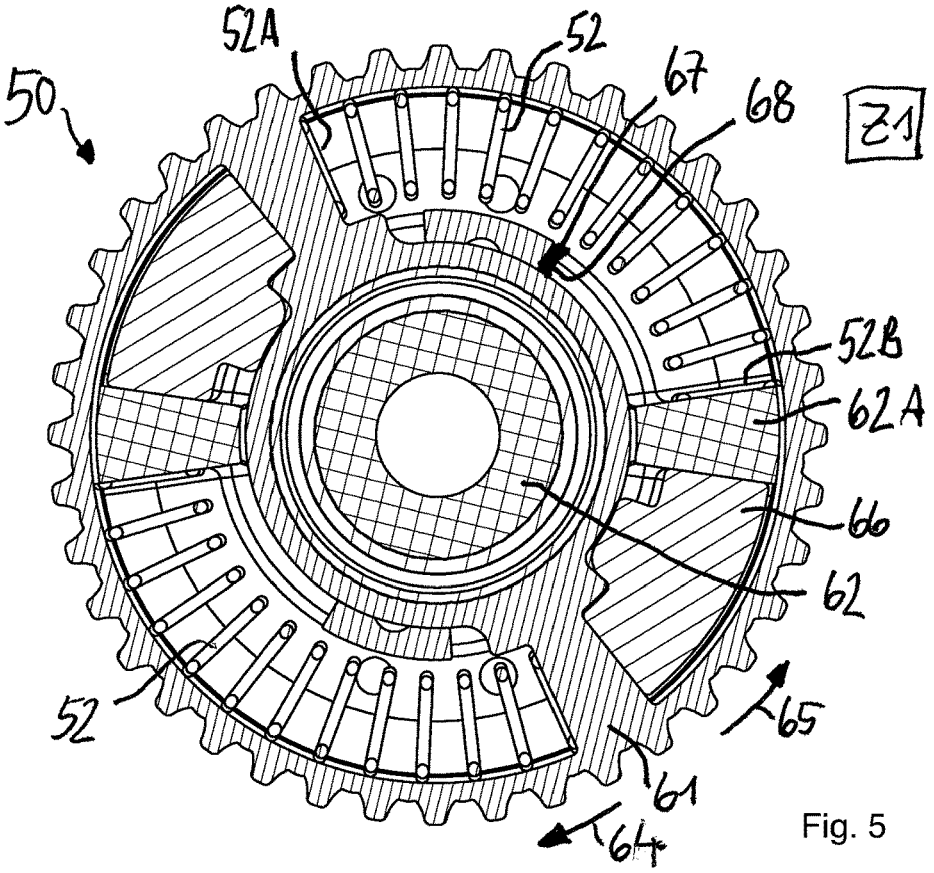
Figure 6:
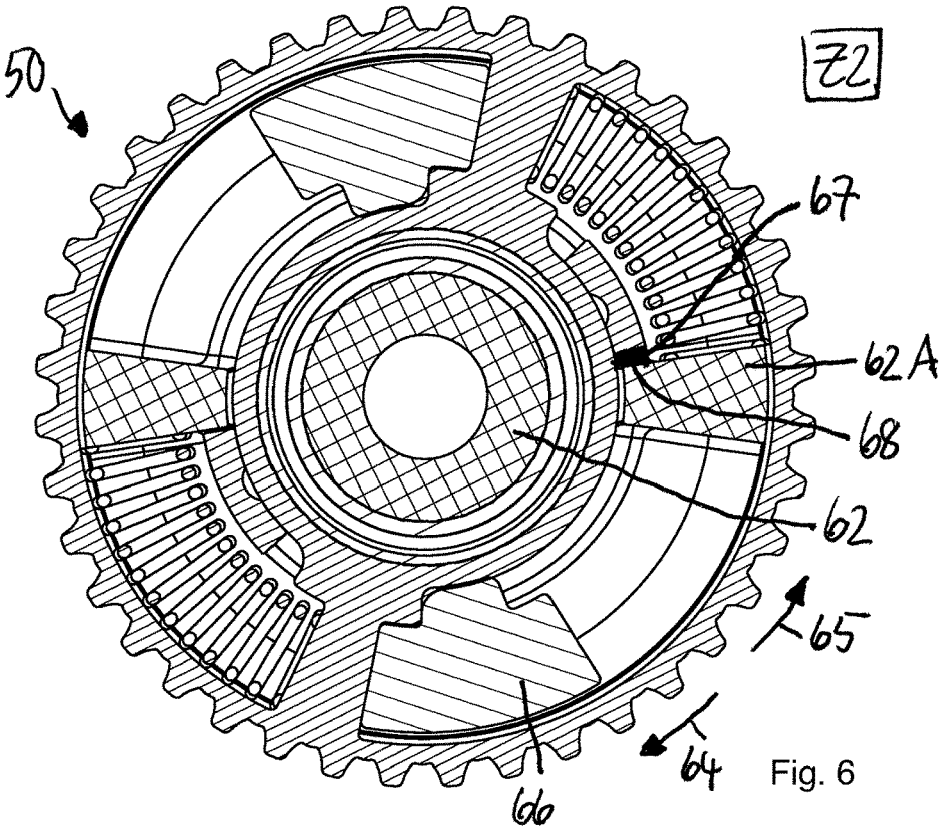
Figure 7:
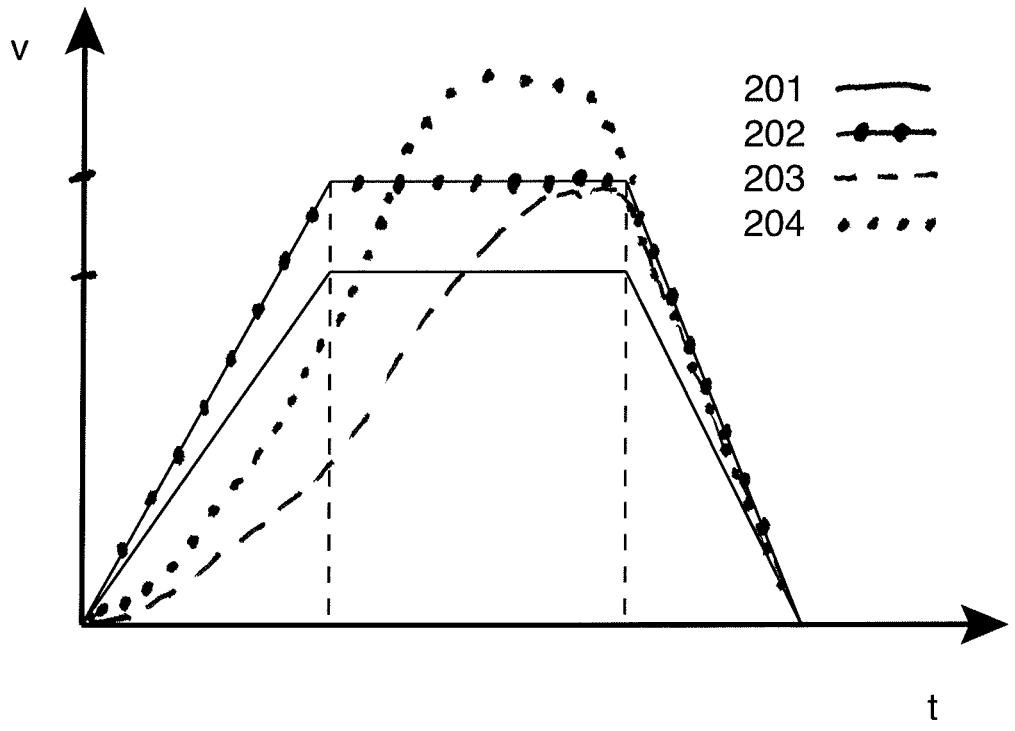
Figure 8:
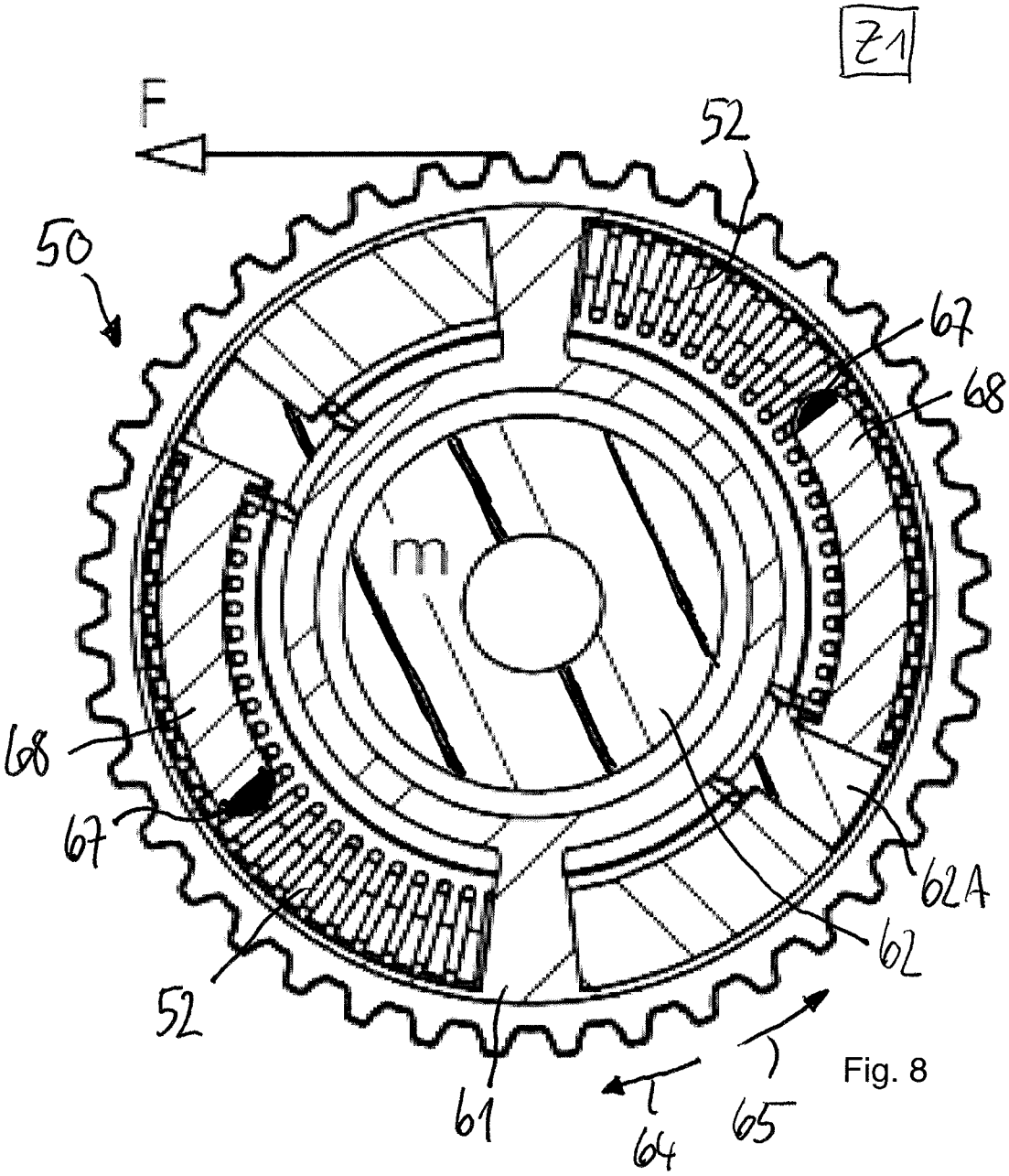
Figure 9:
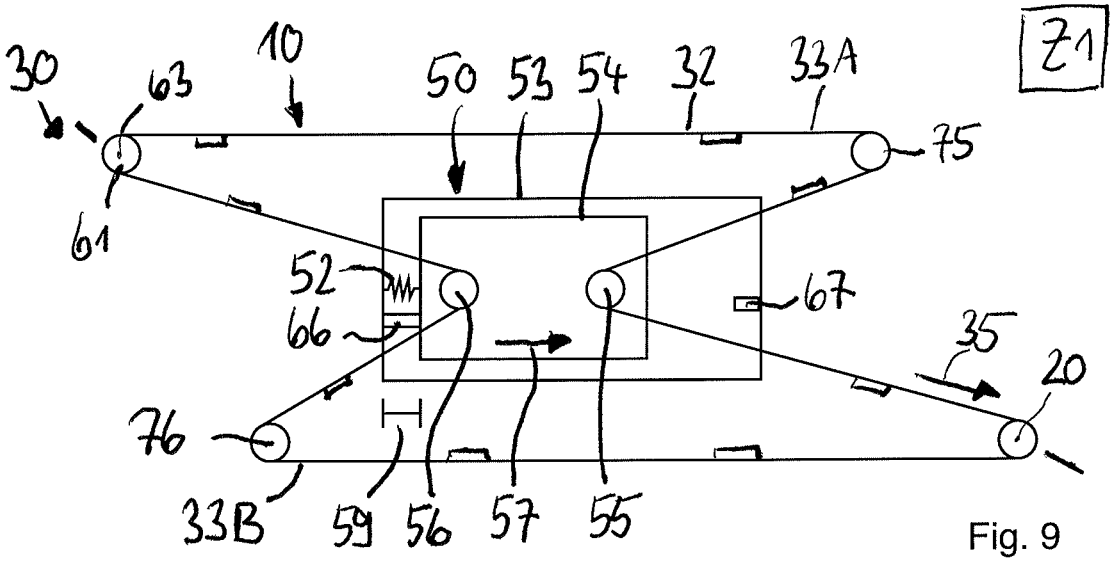
Figure 10:
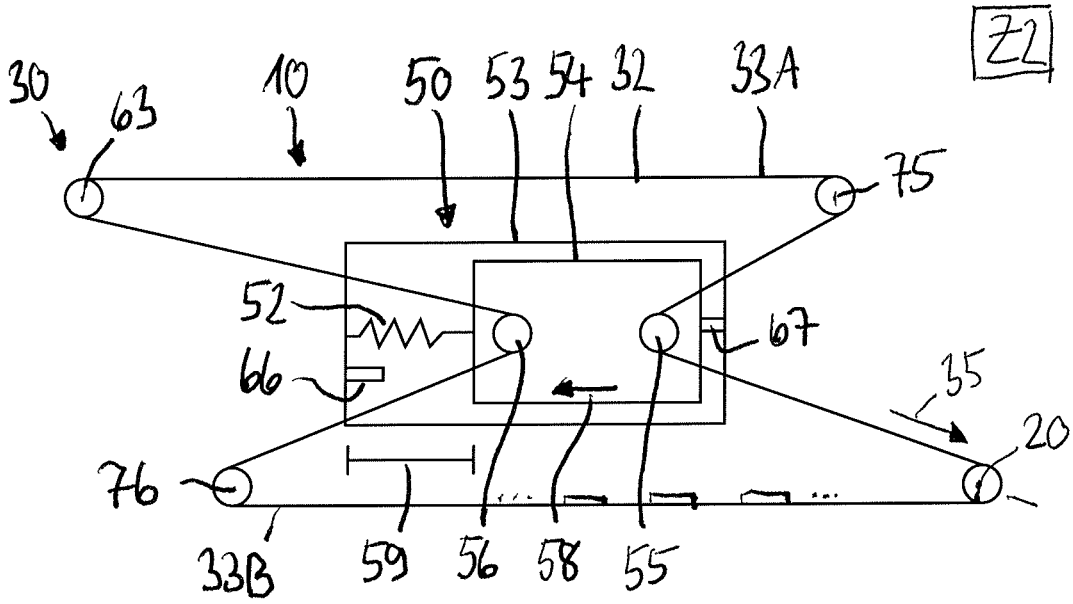
Figure 11:
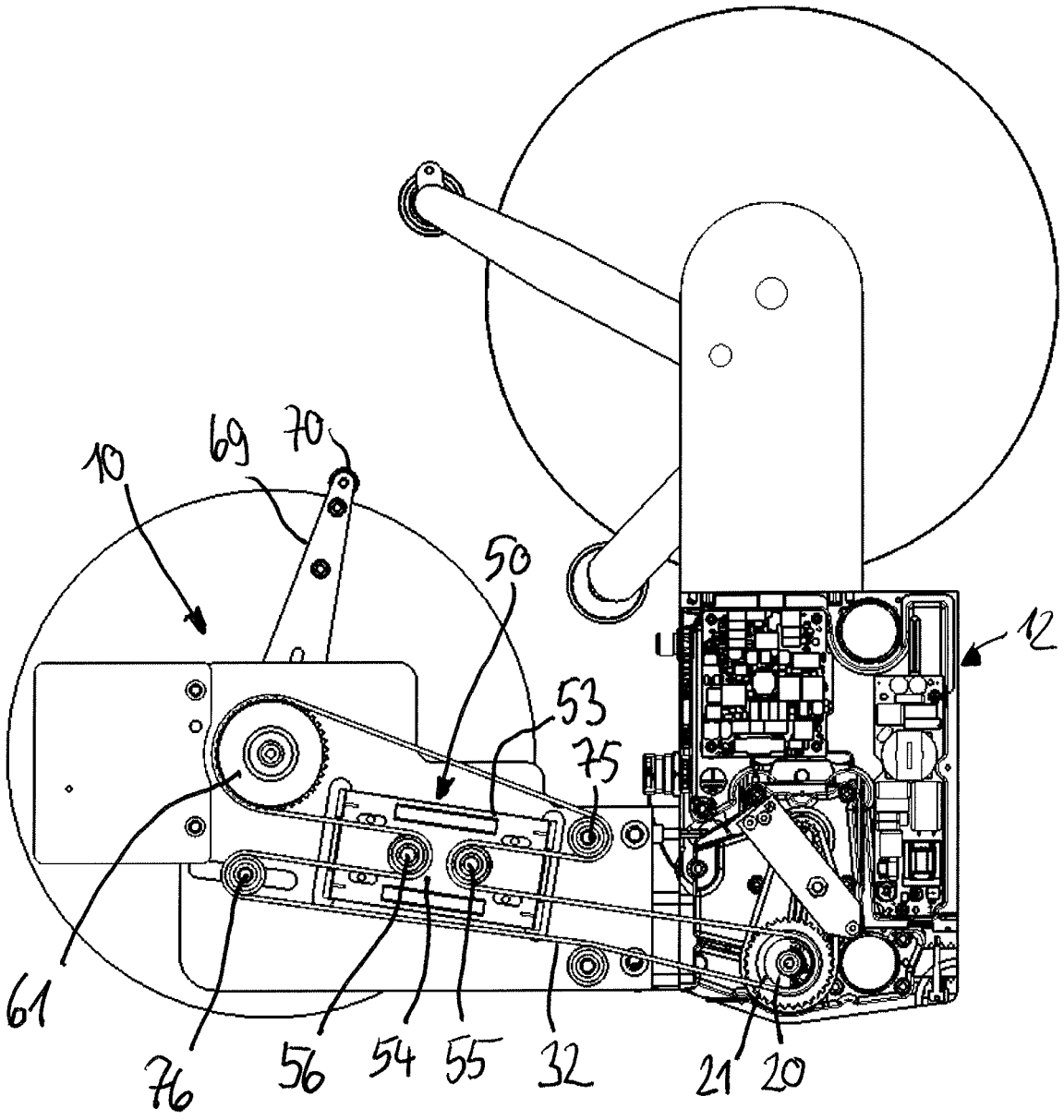
Figure 12:
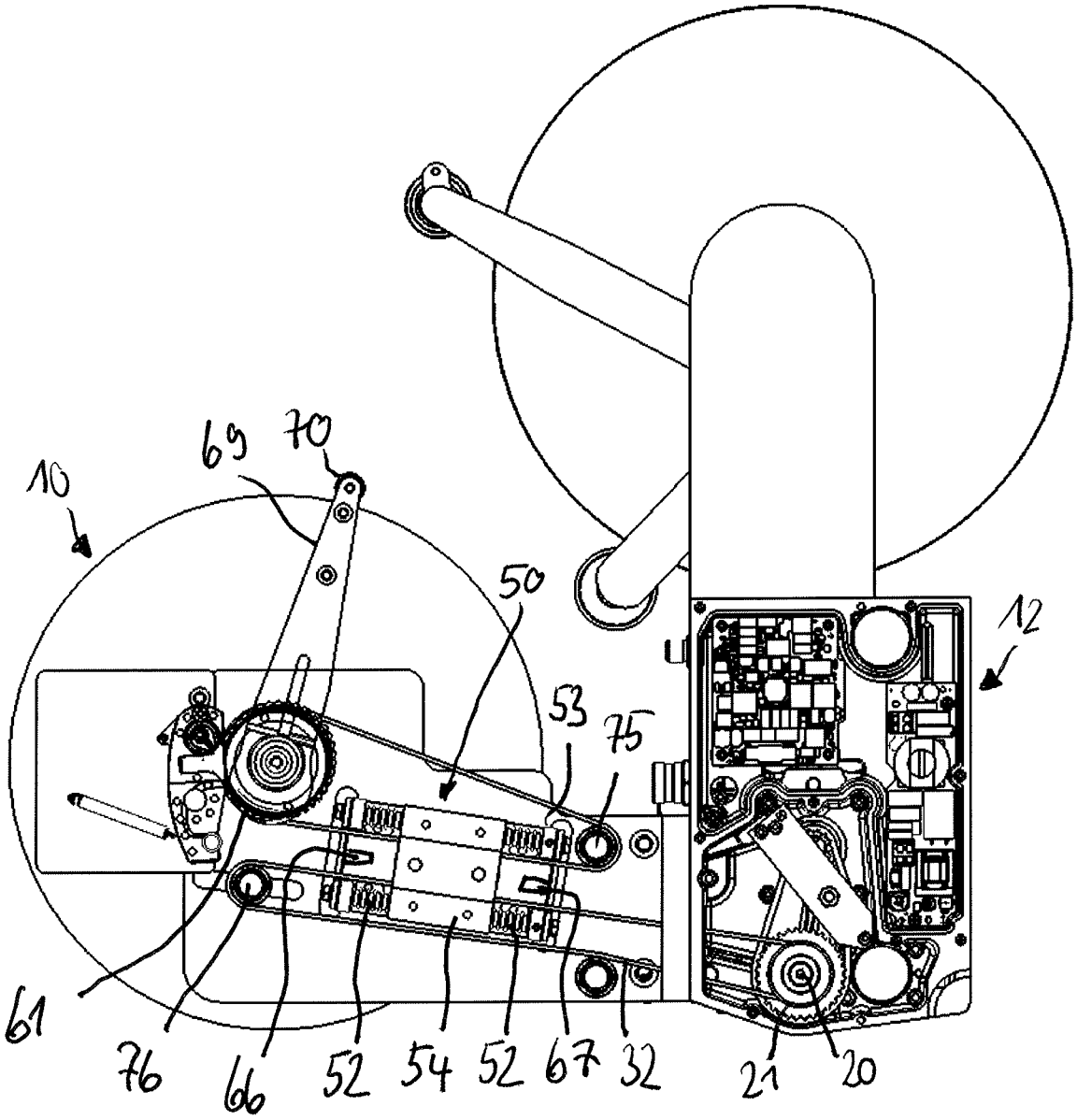
Figure 13:
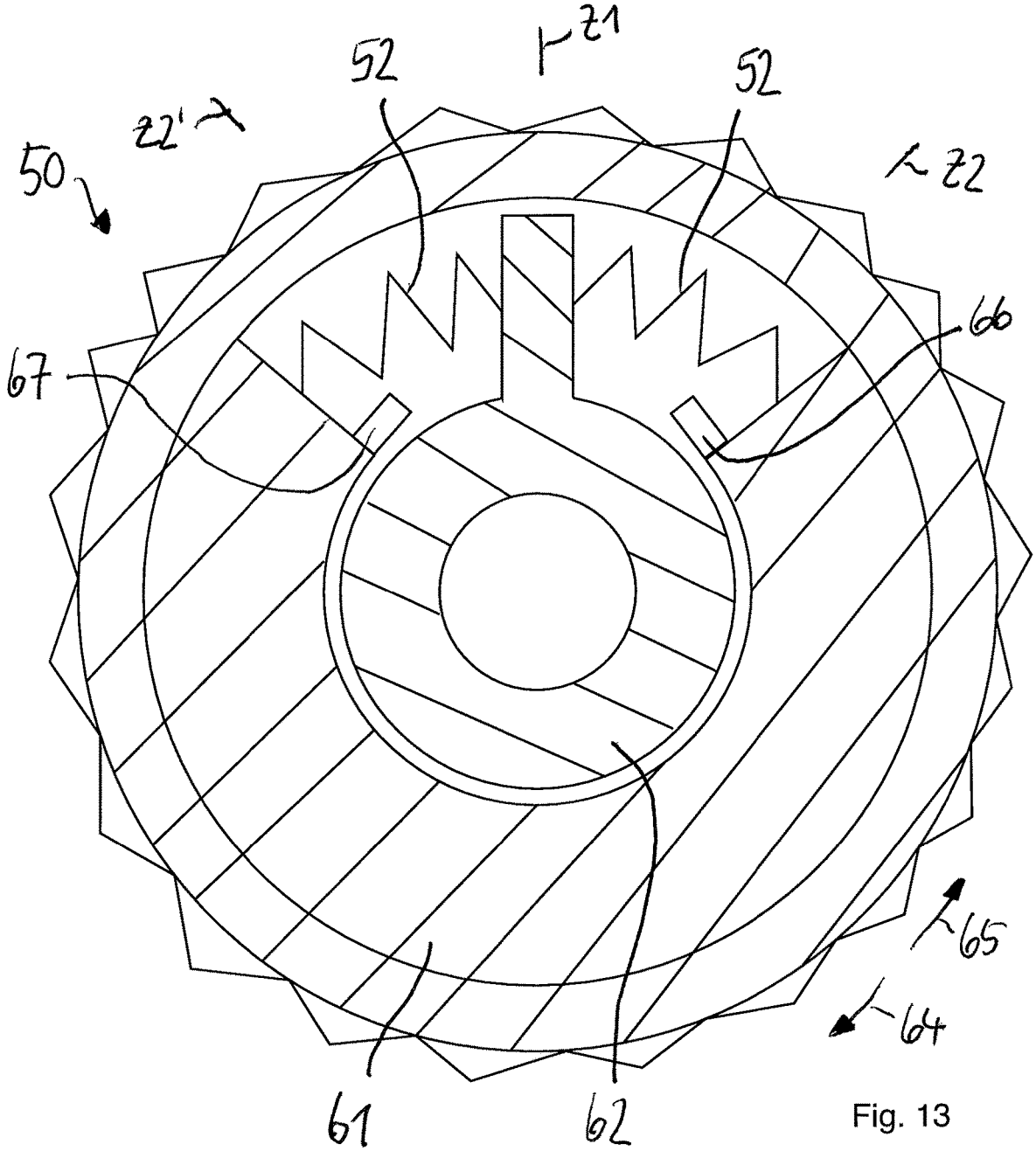
Figure 14:
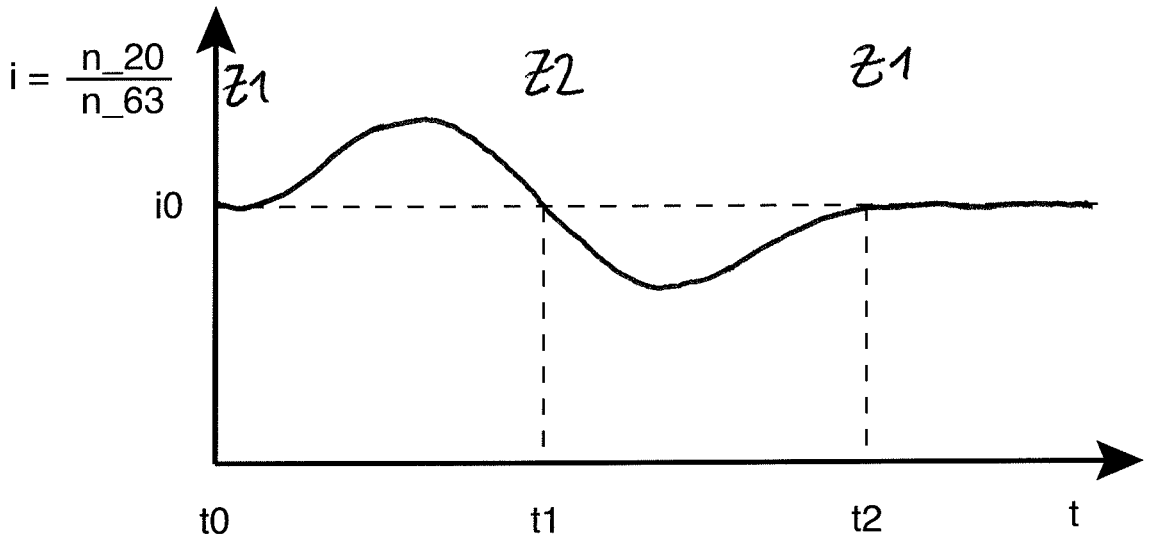
Figure 15:
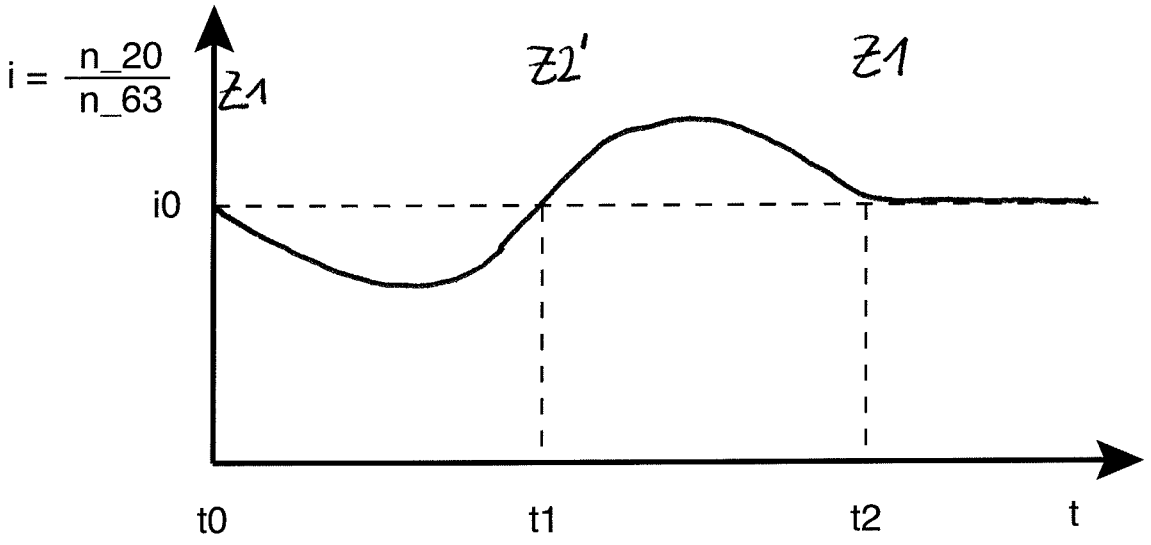
Figure 16:
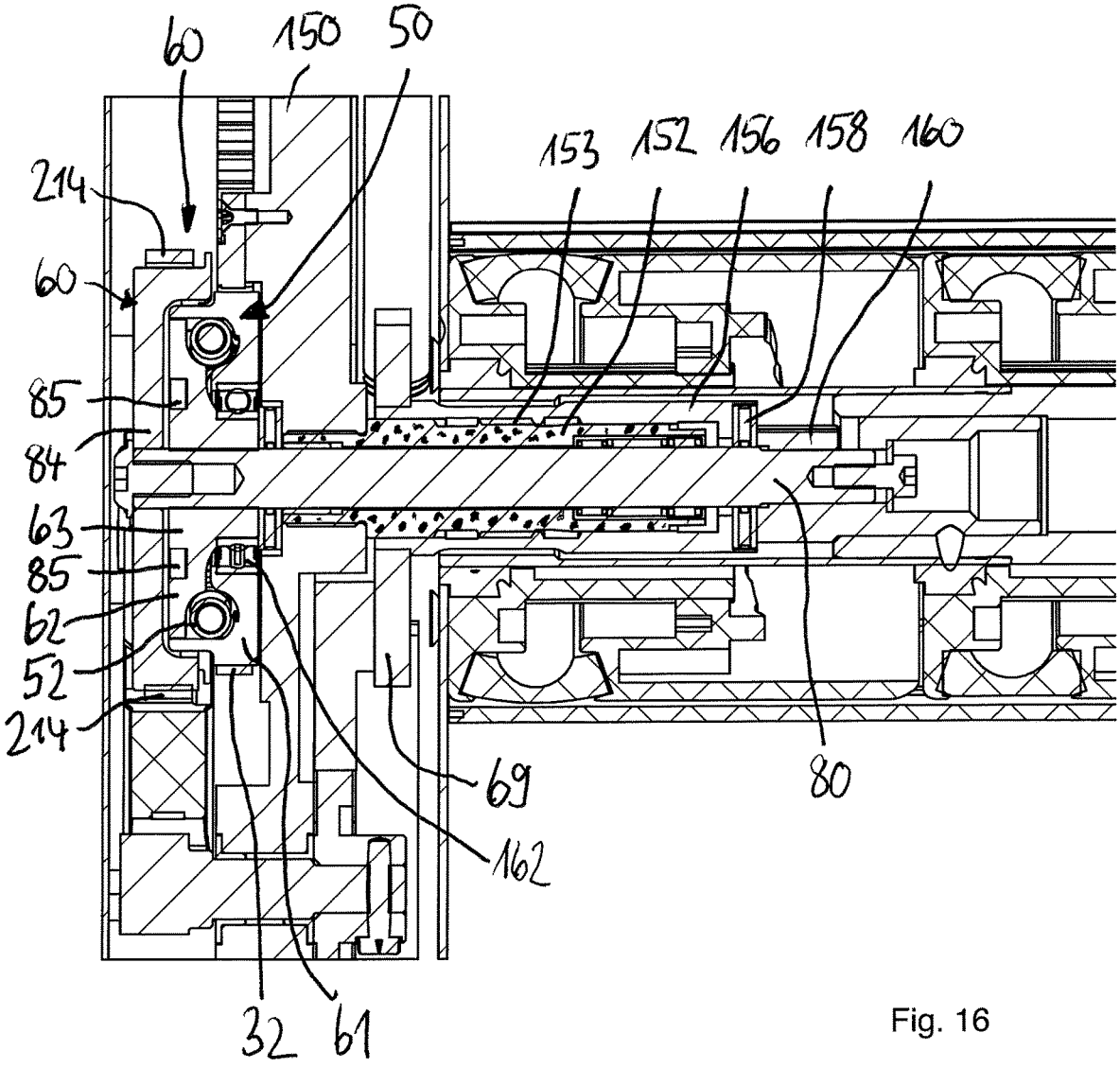
Figure 17:
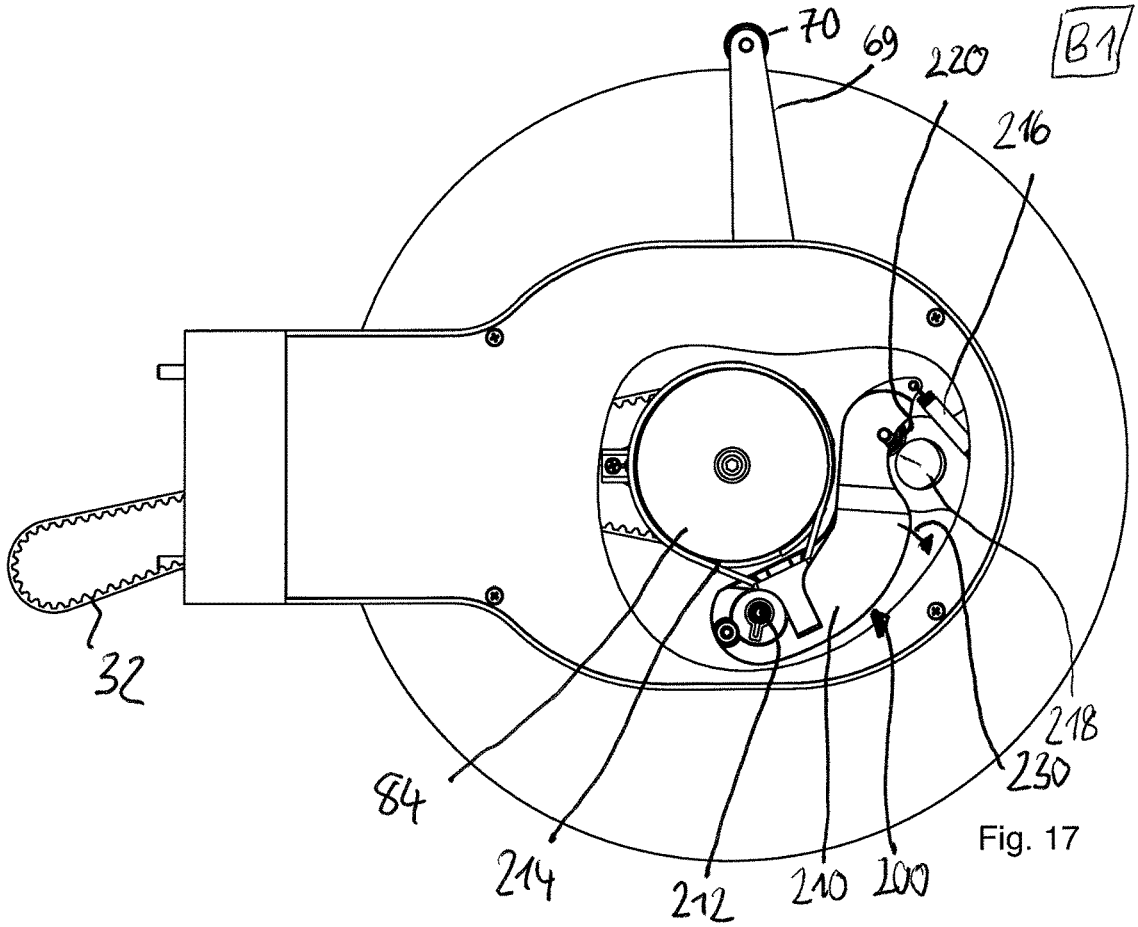
Figure 18:
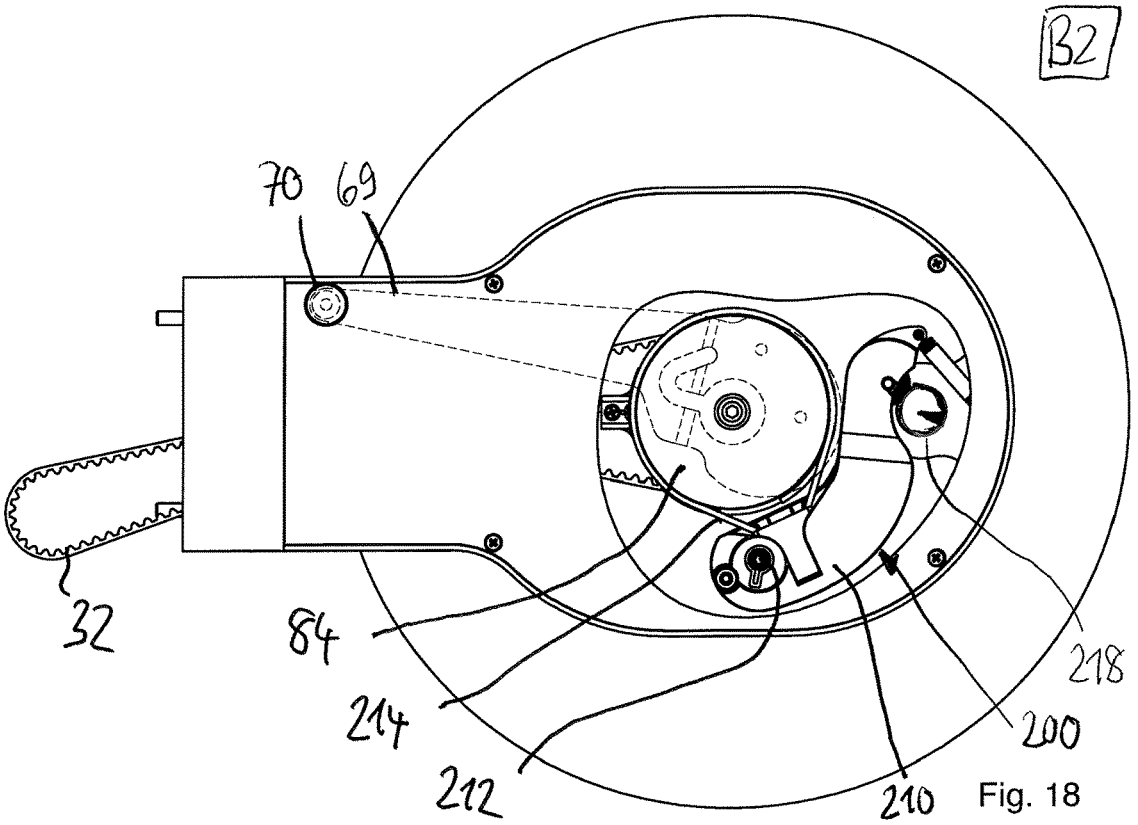
Figure 19:
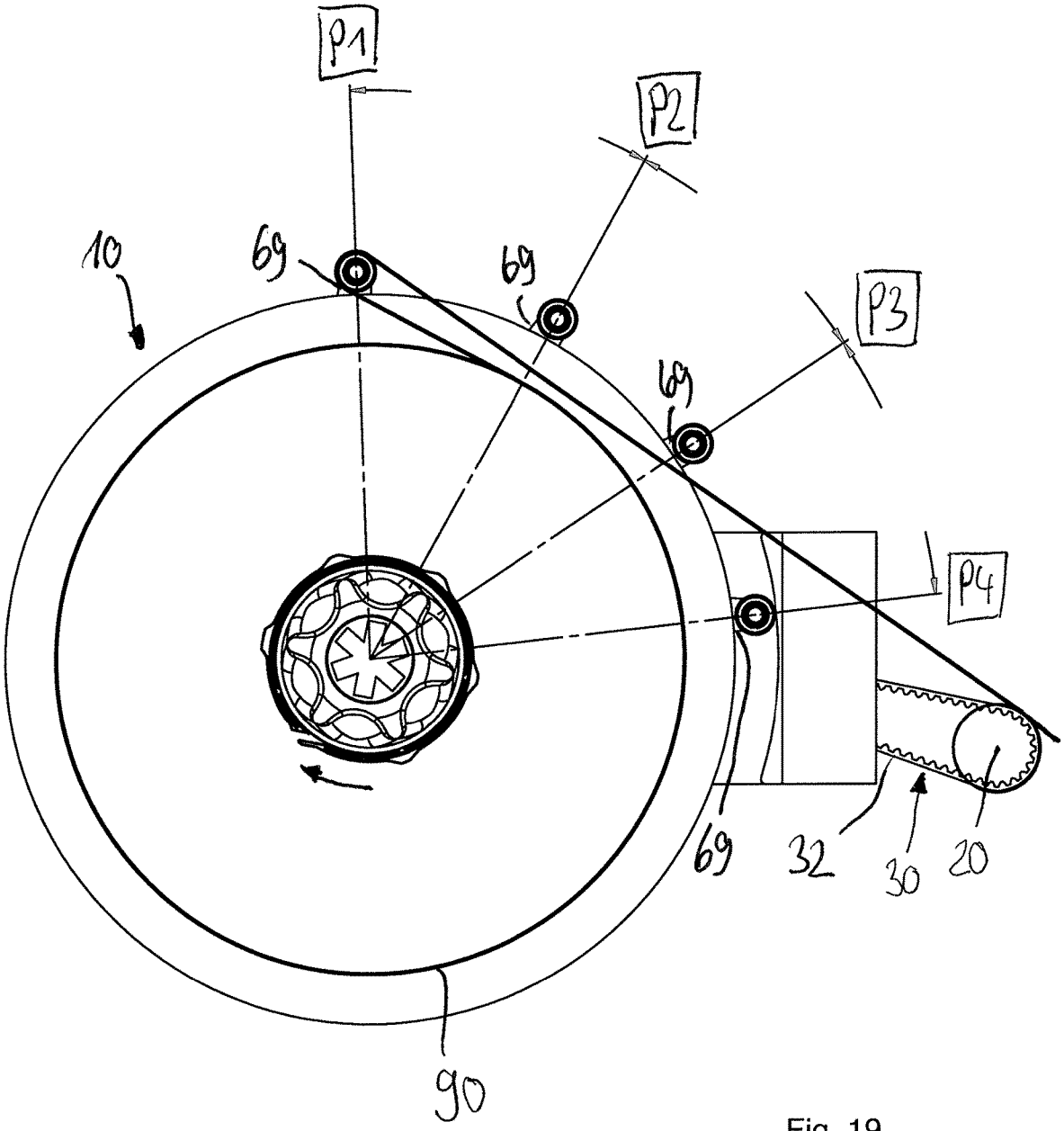

FIG. 1 shows a frontal view of a labelling device with a rewinder,

FIG. 2 shows a sectional representation of a first exemplary embodiment of a rewinder with a gear, FIG. 3 shows a side view of a schematic representation of the first rewinder from FIG. 2, FIG. 4 shows a top view of a schematic representation of the first rewinder from FIG. 3, FIG. 5 shows a sectional side view of an exemplary embodiment of a first exemplary embodiment of an energy storage means in a first state Z1, FIG. 6 shows a sectional side view of the exemplary embodiment of the energy storage means from FIG. 5 in a second state Z2, FIG. 7 shows a schematic diagram with different web speeds, FIG. 8 shows a sectional side view of a second exemplary embodiment of an energy storage means in a first state Z1, FIG. 9 shows a side view of a schematic representation of a second exemplary embodiment of a rewinder with an energy storage means in a first state, FIG. 10 shows the energy storage means from FIG. 9 in a second state, FIG. 11 shows a sectional rear view of the second exemplary embodiment of the rewinder, FIG. 12 shows a further sectional rear view of the second exemplary embodiment of the rewinder from FIG. 11, FIG. 13 shows a sectional side view of a schematic representation of a third exemplary embodiment of the energy storage means, FIG. 14 shows a schematic diagram with the transmission ratio i during acceleration, FIG. 15 shows a schematic diagram with the transmission ratio i during braking, FIG. 16 shows a section, along the sectional line XV from FIG. 2, of a preferred embodiment of the rewinder, FIG. 17 shows a partially sectional rear view of a rewinder with a braking device in a first state B1, FIG. 18 shows the rewinder from FIG. 17 with the braking device in a second state B2, and FIG. 19 shows a frontal view of the rewinder with different positions of a pendulum.

DETAILED DESCRIPTION

Terms such as left, right, top, bottom, clockwise and anticlockwise relate to the figure in question and can change from figure to figure. The same reference symbols are used for identical parts or parts with the same function, and they are usually only described once.

FIG. 1 shows by way of example an application with a labelling device 12, a rewinder 110, a winding device 10 and a dispensing device 140, which is also referred to as a release device.

A reel 111 with a label web 130 is arranged on the rewinder 110. The label web 130 comprises a carrier web 131 and labels 132 arranged thereon. The label web 130 runs from the label web reel 111 via a braking device 115 to the dispensing device 140. The dispensing device 140 has a dispensing beak 141, and the label web 130 is passed around the dispensing beak 141. Since the label web 130 performs a sudden change in the direction of movement at the dispensing device 140, the corresponding label 132 is detached from the label web 130 and projects forwards from the dispensing device 140. An object to be labelled 142 can be passed by the dispensing device 140 and the dispensed label 132 applied to the object 142. The remaining carrier web 131 of the label web 130 is, by way of example, fed back to the labelling device 12, and a drive device 14 with a drive roller—not visible—is provided on the labelling device 12 which drives the carrier web 131. The carrier web 131 then runs on further to the winding device 10 where it is rewound. Because the label web 130 or carrier web 131 is pulled over the dispensing device 140 by the drive roller and is braked, on the feed side, by the braking device 115, it lies taughtly or under tension against the dispensing device 140.

In operation, the label web 130 can either be driven continuously by the drive device 14 or a cyclic operation can be carried out, in which the label web 130 is briefly stopped between the dispensing actions until the next object to be labelled 142 is positioned at the dispensing device 140. Modern high-speed labelling machines 12 dispense labels 132 at the dispensing device 140 with a label web speed of for example 3.3 m/s in cyclic operation, that is to say, very high speeds and accelerations are possible.

The rotation of the rewinder 110 is influenced by a pendulum 112 which changes its pendulum position depending on the tension of the label web 130.

The rotation of the winding device 10 is influenced by a pendulum 69 which changes its pendulum position, depending on the tension of the carrier web 131. For this purpose, for example a spring—not shown—is connected with the pendulum 69 which applies a force to the pendulum in an anticlockwise direction of rotation, so that the carrier web tension can act against this force. The pendulum 69 can also be described as a lever or arm. The pendulum 69 serves on the one hand to measure the web tension of the carrier web 131. On the other hand, it also has the function, through its rotation, of effecting a web compensation, in order that the web tension does not become too high or too low.

Traction Gear

FIG. 2 shows the labeler 12 with the winding device 10 from behind, in a sectional representation.

A drive device 14 is provided around the labeler 12, for example an electric motor, a servo drive or a pneumatic drive. The drive device 14 drives a drive shaft 20, wherein the drive shaft 20 drives the label web via a—not shown—drive roller. The drive shaft 20 is also connected directly or indirectly with a drive shaft element 21, and the winding device 10 is also driven via this drive shaft element. For this purpose, a traction gear is provided which enables a rotation of the drive shaft element 21 on a first clutch shaft element 61.

The traction gear 30 is configured as a positive-engagement traction gear with a traction means 32, said traction means 32 interacting with the first clutch shaft element 61 and the drive shaft element 21 and enabling a transmission of torque from the drive shaft element 21 to the first clutch shaft element 61. The path of the traction means 32 is additionally influenced through a pulley 34, and the pulley 34 causes an enlargement of the peripheral range over which the traction means 32 lies against the drive shaft element 21 and the first clutch shaft element 61. In addition, the opening in the labeler 12 which is provided for the path of the traction means 32 can be made smaller.

The traction gear 30 is configured as a toothed belt gear with a toothed belt as traction means 32 and with a belt pulley as first clutch shaft element 61. The drive shaft element 21 can also be configured as a belt pulley.

Alternatively, the traction gear 30 can be configured as a chain gear with a chain as traction means 32, and the first clutch shaft element 61 and preferably also the drive shaft element can be configured as a sprocket.

As a result of the positive-engagement configuration of the traction means—unlike for example a round belt gear or V-belt gear—no slipping is possible. This is advantageous since, in the case of a round belt gear, slipping leads to wear and to soiling in the region of the gear.

The winding device 10 has a flange 150 onto which parts can be attached. The pendulum 69 with the web guide 70, in the form of a roller, is shown.

FIG. 3 shows in schematic representation a side view of the winding device 10, and FIG. 4 shows a top view of the representation from FIG. 3. The drive shaft 20 is connected with the drive shaft element 21 and the drive shaft element 21 drives the traction means 32. The traction means 32 interacts with the first clutch shaft element 61, and the first clutch shaft element 61 interacts with a second clutch shaft element 62 as energy storage means 50. The second clutch shaft element 62 is connected with a clutch shaft 63, and the clutch shaft 63 is connected via a clutch 60 with an output shaft 80. A rotation of the first drive shaft element 21 can thus be translated into a rotation of the output shaft 80; however, a separation of the rotations from each other or a separation of the transmission of torque is also possible via the clutch 60. As illustrated schematically, a reel 90 for rewinding the carrier web 131 is attached to the output shaft 80.

Rotary Energy Storage Means 50

FIG. 5 shows the energy storage means 50, which comprises the first clutch shaft element 61 and the second clutch shaft element 62. The energy storage means is shown in a first state Z1. The second clutch shaft element 62 is connected firmly with the clutch shaft 63, and the first clutch shaft element 61 and the second clutch shaft element 62 are arranged concentrically with the clutch shaft 63 and are rotatable relative to each other. The first clutch shaft element 61 associated with the clutch shaft 63 is thus only connected indirectly with the clutch shaft 63. In FIG. 5, the first clutch shaft element 61 can for example be rotated relative to the second clutch shaft element 62 in a first direction of rotation 64 and, depending on the current state of the energy storage means 50, also in a second direction of rotation 65. Two spring elements 52 are arranged between the first clutch shaft element 61 and the second clutch shaft element 62. The spring element 52 is at one point 52*a* in contact with the first clutch shaft element 61 and at an opposite point 52*b* in contact with the second clutch shaft element 62, wherein the second clutch shaft element 62 has for this purpose an outwardly projecting projection 62A which is connected firmly with the clutch shaft element 62. The projection 62A can also be described as a lug.

The spring elements 52 are, by way of example, configured as coil springs, and a curved bow spring is preferably used. However, other spring elements 52, for example disc springs, are also possible.

The second clutch shaft element 62 lies against a first damping element 66, said first damping element 66 consisting for example of a PU (polyurethane) foam such as VULKOLLAN (US TM Reg. Numbers 1,572,694 & 5,273,576) or an elastomer. This simultaneously forms a stop. It can be specified, from the relative rotary position of this stop, whether the spring element 52 is preloaded in the first state Z1, and if so how high this preloading is. However, the preloading can also for example be effected via the selection of the spring element 52. A first stop 68 is provided on the first clutch shaft element 61, and a damping element 67 is provided on the first stop 68 which consists, for example, of a soft component of a 2-component injection molding process, of an elastomer or of a PU (polyurethane) foam. The spring elements 52 are relaxed or slightly preloaded in the first state Z1, and the second clutch shaft element 62 lies against the damping element 67.

FIG. 6 shows the energy storage means 50 in a second state Z2, in which additional potential energy is stored in the spring element 52. The position of the second clutch shaft element 62 is unchanged in comparison with FIG. 5; however, in comparison with the representation in FIG. 5, the first clutch shaft element 61 has been rotated relative to the second clutch shaft element 62 in the direction of rotation 64. As a result, the spring element 52, which is arranged between the first clutch shaft element 61 and the second clutch shaft element 62, is compressed. The first stop 68 lies against the second clutch shaft element 62 and thus prevents a further rotation relative to the second clutch element 62 in the direction of rotation 64.

Functional Principle of the Rotary Energy Storage Means 50

As a result of a rotation of the drive shaft element 21, the traction means 32 (see FIG. 2 and FIG. 3) causes a rotation of the first clutch shaft element 61 with a transmission ratio i, said ratio i corresponding to the quotient of the rotational speed of the drive shaft element 21 and the rotational speed of the first clutch shaft element 61. Thus:

$$i=n_21/n_61$$

With the clutch 60 closed (see FIG. 4), the rotation of the first clutch shaft element 61 is transmitted to the second clutch shaft element 62 and then via the clutch 60 to the output shaft 80 and leads to a rotation of the reel 90. Without the energy storage means 50 taking effect, and without slip in the clutch 60, a predetermined transmission ratio i_0 thus also exists between the rotational speed of the drive shaft element 21 and the output shaft 80, which can also be described as a basic transmission ratio i_0. The basic transmission ratio i_0 occurs for example if the drive shaft element 21 is operated at constant rotational speed or with only slight acceleration of the rotational speed, and is determined by the mechanical structure, for example by the number of teeth.

If the clutch 60 is, for example, configured as a friction clutch, slip can occur if, due to the high inertia of the reel 90, the torque to be transmitted via the clutch 60 becomes greater than a maximum torque which is to be transmitted by the clutch 60. In this case, the rotation of the first clutch shaft element 61 is only partially transmitted to the output shaft 80, and it is partially converted into heat in the clutch 60 through friction.

The energy storage means 50 is provided, in order to reduce or preferably completely prevent slip in the clutch 60. In the event of a powerful acceleration of the traction means 32 in the direction of rotation 64 indicated in FIG. 5, the spring element 52 is compressed or loaded due to the inertia of the clutch shaft 63 and the output shaft 80 and reel 90 connected with this; the movement of the first clutch shaft element 61 in the direction of rotation 64 is thus not transmitted immediately to the clutch shaft 63 but is partially stored as potential energy 52. Upon a movement of the first clutch shaft element 61 relative to the second clutch shaft element 62 in the direction of rotation 64, upon compression of the spring element 52, the rotary movement of the first clutch shaft element 61 is only partially transmitted to the second clutch shaft element 62 and thus to the clutch shaft 63, and this leads to an increase of the transmission ratio i, since the clutch shaft 63 rotates comparatively more slowly than with the basic transmission ratio i_0. Thus, when energy is stored in the spring element 52: i>i_0. Starting out from the state Z1 shown in FIG. 5, the energy storage means 50 thus shifts into the state Z2 shown in FIG. 6 or at least partially in the direction of the state Z2 shown in FIG. 6.

If the spring element 52 is compressed, it attempts to relax again and release the potential energy. This takes place, in that the spring element 52 rotates the second clutch shaft element 62 relative to the first clutch shaft element 61 in the direction of rotation 64. As the spring element 52 is relaxed, the potential energy stored in the spring element 52 is thus released again, and the transmission ratio i is lowered in comparison with the basic transmission ratio i_0 without the influence of the energy storage means 50, since the rotational speed n_63 of the clutch shaft 63 is increased on release of the potential energy in relation to the rotational speed n_61 of the first clutch shaft element 61. Thus, on release of the potential energy: i<i_0.

The consideration of the relative rotation between the first clutch shaft element 61 and the second clutch shaft element 62 simplifies the consideration of the energy flow. However, the actual rewinding of the carrier web 131 usually only takes place in one direction of rotation, and both the first clutch shaft element 61 and also the second clutch shaft element 62 fundamentally rotate in the same direction of rotation 64 on a transmission of torque. The rotational speed n_62 of the second clutch shaft element 62 is hereby somewhat lower during the storage of energy in the energy storage means (transition in the direction from Z1 to Z2) than the rotational speed n_61 of the first clutch shaft element 61, and on releasing energy from the energy storage means (transition in the direction from Z2 to Z1) the rotational speed n_62 is somewhat higher than the rotational speed n_61, wherein both clutch shaft elements 61, 62 usually rotate in the same direction of rotation 64.

The energy storage means 50 thus causes a delayed transmission of the energy transmitted from the drive shaft element 21 or of the torque transmitted from the drive shaft element 21 to the clutch shaft 63 or to the output shaft 80.

The damping element 67 on the stop 68 prevents a hard stop of the stop 68 against the second clutch shaft element 62. Tests have shown that in the event of a hard stop a torque such as a jerk can be transmitted via the traction gear 30 to the drive shaft 20 (see FIG. 2), and such a transmission of torque to the drive shaft 20 can lead to problems and inaccuracies, if for example a drive with position control is used. In particular, if the drive or the drive shaft 20 is used simultaneously for the movement of a label web, negative movements in particular are undesirable. The damping element 67 has therefore proved very positive for the function of the rewinder 10, likewise the damping element 66.

FIG. 7 shows four curves 201, 202, 203, 204, which in each case show a speed of the web 131 at different points.

The line 201 shows the speed with which the carrier web 131 is accelerated and braked again by the labeler 12 (see FIG. 1) during a dispensing action in cyclic operation. The profile is, by way of example, an edge profile, with a rising edge, a region with constant speed and a falling edge. Other profiles are also possible, for example with variable speed in the middle region. Thus, a label is always dispensed and then the label web is stopped again until the next object to be labelled is ready in position.

The line 202 shows the speed with which the web is wound onto the reel 90. Where an additional drive is used for the winding device 10, the rotational speed can be adjusted to the necessary rotational speed. However if, as in the exemplary embodiment, the drive for the labeler 12 is used directly, which can also be described as a passive function of the main drive, the speed is dependent on how much web 131 has already been wound onto the reel 90, since the diameter of the rewound web 131 increases during rewinding. The speed is for example adjusted such that a maximum speed occurs with an empty reel 90 which corresponds to 110 percent of the speed of the web 131 at the labeler 12. This means that a reserve is provided, if for example a slip occurs in the clutch 60 or if for example the web 131 is not tensioned to begin with.

The line 203 shows the speed of the web on the reel 90 if a slip occurs on the clutch 60 and no energy storage means 50 is provided. Due to the powerful acceleration at the rising edge, a slip occurs in the clutch 60, and the rotary movement is initially largely translated into frictional heat in the clutch 60, not into a rotation of the reel 90. At a certain point, the clutch engages, and the output shaft 80 is powerfully accelerated. However, shortly after reaching the maximum rotational speed, the web speed is lowered again due to the falling edge. The total path covered corresponds to the area below the respective curve. The area below the curve 203 is less than the area below the curve 201, and therefore the winding device 10 takes in less web than is moved by the labeler 12. This can lead to the web no longer being taut, or even falling to the ground or becoming entangled in another part. This is an undesirable state. In tests, in particular with very short labels with high accelerations, a slip in the clutch 60 has led to problems since the clutch 60 has become very heated due to the slip occurring at short intervals, and the drive of the reel 90 was insufficient. With longer labels too, the heating of the clutch 60 was critical, but the drive of the reel was less critical.

Tests were also carried out with a clutch with high coupling force in order to reduce the slip. These tests led to a high torque being transmitted to the drive of the labeler 20, and the drive registered an overload.

The line 204 shows the web speed on the winding device 10 using the energy storage means 50. Since the movement caused through the traction means 32 is only partially transmitted to the clutch shaft 63 and is partially used for the storage of potential energy in the energy storage means 50, the output shaft 80 can follow the movement of the clutch shaft 63 with the reel 90. No slip, or only a slight slip, occurs in the clutch 60. The potential energy stored in the energy storage means is translated at a later time into an additional rotation of the clutch shaft 63 and thus also the output shaft 80, and as a result an increase in the maximum rotational speed of the output shaft 80 and thus an increase in the web speed can occur. The area below the line 204 is greater than the area below the line 201, and the winding device 10 can therefore work well.

These remarks apply to a closed clutch 60. In the case of an opened clutch 60, the mass adhering to the clutch shaft 63 is much smaller, and therefore the second clutch shaft element 62 can follow the first clutch shaft element 61 without any problem, and either no compression or only a slight compression of the spring element 52 occurs.

FIG. 8 shows a further exemplary embodiment of the energy storage means 50. The energy storage means 50 is comparable with FIG. 5. in the energy-charged state Z1. A first stop 68 is provided on the second clutch shaft element 62 which extends into the inner region of the spring element 52.

The spring element 52 is, as in FIG. 5, configured as a coil spring, and a curved bow spring is preferably used. The stop 68 is preferably correspondingly curved, and if the first clutch shaft element 61 is moved relative to the second clutch shaft element 62 in the direction of rotation 64, the stop 68 comes into contact with the first clutch shaft element 61 following a predetermined rotary movement. The embodiment of the stop 68 shown is advantageous, since the stop 68 is at the same time configured as a guide for the spring element 52. The stop 68 can have a damping element 67 at the free end which consists wholly or partially of an elastic material, for example of an elastomer, and as a result, in addition, a damping can be achieved through the stop 68 if this is moved against the first clutch shaft element 61.

Linear Energy Storage Means 50

FIG. 9 shows a further exemplary embodiment of the energy storage means 50, wherein the energy storage means is in a first state Z1. The drive shaft 20 and the clutch shaft 63 are connected with each other via a traction gear 30 with pulleys 75, 76. The traction gear 30 has a traction means 32 which is in contact with the drive shaft 20 and the clutch shaft 63. The energy storage means 50 has a carriage guide 53 and a carriage 54, said carriage 54 being displaceable relative to the carriage guide 53. At least one spring element 52 is arranged between the carriage 54 and the carriage guide 53, and the carriage 54 has at least one first pulley 55 which is in contact with the traction means 32. The path of the traction means 32 runs from the drive shaft 20 to the clutch shaft 63 and from the clutch shaft 63 back to the drive shaft 20. This path can be divided into a first partial path 33A and a second partial path 33B, wherein both partial paths 33A and 33B in each case run between the drive shaft 20 and the clutch shaft 63. The first partial path 33A passes by the first pulley 55, so that the traction means 32 is in contact with the first pulley 55. The second pulley 56 is also in contact with the traction means 32, but in the region of the second partial path 33B.

FIG. 10 shows the traction gear 30 of the winding device 10 from FIG. 9 in a second state Z2 of the energy storage means 50. The carriage 54 is moved to the right in comparison with FIG. 9 in a direction 57. This displacement of the carriage 54 leads to a displacement of the first pulley 55 and the second pulley 56, and as a result the first partial path 33A is reduced relative to the state Z1 shown in FIG. 9 and the second partial path 33B is extended. This can be seen on considering the distance 59 between the carriage 54 and an edge of the carriage guide 53. As a result of the displacement of the carriage in the direction 57, the partial path between the drive shaft 20 and the first pulley 55 and the partial path between the first pulley 55 and the pulley 75 become shorter, and in the same way the partial path between the clutch shaft 63 and the second pulley 56, as well as the partial path between the second pulley 56 and the pulley 76, become longer. Upon a movement of the traction means 32 in the direction 35 and a shortening of the first partial path 33A, the drive shaft 20 must rotate further, in order to effect the same rotary movement of the clutch shaft 63. Upon the transition of the energy storage means from the first state Z1 shown in FIG. 9 to the second state Z2 shown in FIG. 10, the rotational speed of the clutch shaft 63 is thus lowered in relation to the rotational speed without the effect of the energy storage means 50, and as a result the transmission ratio i increases relative to a basic transmission ratio i_0 if the energy storage means 50 is not moved. In FIG. 10, the energy storage means 50 is charged, since the spring element 52 is loaded. If the carriage 54 is then moved in the direction 58 the first partial path 33A increases, and the second partial path 33B is shortened again. As a result, an additional rotation of the clutch shaft 63 is caused, and during this change of state the transmission ratio i becomes lower than the predetermined transmission ratio of the traction gear 30 without the effect of the energy storage means 50.

The second pulley 56 serves the purpose of length compensation of the path for the traction means 32. This length compensation is advantageous; however, it can also be achieved through an additional length compensation device. The second pulley 56 is thus not essential.

At the end position of the carriage 54, as shown in FIG. 9 (Z1) as the first end position and in FIG. 10 (Z2) as the second end position, a damping element 66 or 67 is in each case provided which is configured to dampen the movement of the carriage 54 towards the respective end position. Depending on the application, it can also be sufficient only to provide a damping element 66 at one of the end positions. The damping elements 66, 67 have the same function as the damping elements 66, 67 from FIG. 5.

Preferably, at least one end position of the carriage 54 is defined by a stop, preferably both end positions. The stops can also be formed through the damping elements 66, 67 in that these are configured as stops with a rubber-elastic end or with another relatively soft material such as PU (polyurethane) foam. However, the stops and damping elements can also be configured as separate components in the exemplary embodiments.

The energy storage means 50 from FIG. 9 and FIG. 10 has the same effect as the energy storage means from FIG. 5 and FIG. 6. If, with the clutch 60 closed, a mass with high moment of inertia is connected with the clutch shaft 63 and the drive shaft 20 performs a powerful acceleration, a part of the movement of the traction means 32 is not translated directly into a rotation of the clutch shaft 63; instead, the energy storage means 50 is activated and moves from the first state Z1 shown in FIG. 9 in the direction of the second state Z2 shown in FIG. 10. If the clutch shaft 63 has been set into rotation together with the connected inertial mass, the energy storage means 50 can release the energy stored in the spring element 52 again and as a result cause an additional rotation of the clutch shaft 63.

This leads to a relief of the clutch 60, since the risk of a slip is reduced or wholly prevented, and the movement of the traction means 32 can as a result be translated into a rotation of the clutch shaft 63, completely or at least to a greater extent than without the use of an energy storage means 50.

If the linear energy storage means from FIG. 9 and FIG. 10 is used, the first clutch shaft element 61 assigned to the clutch shaft 63 can be connected directly with the clutch shaft 63, or the rotary energy storage means from FIG. 5 and FIG. 6 can be used in addition, as a result of which an indirect connection between the clutch shaft 63 and the first clutch shaft element 61 is created.

In the linear energy storage means shown in FIG. 9 and FIG. 10, the spring element 52 can also be replaced with a cable attached to the carriage 54 which runs to the left and is deflected via a pulley so that it hangs downwards. A weight can be attached at the lower end of the cable so that moving the carriage 54 to the right raises the weight and thus also increases the potential energy in the form of gravitational potential energy.

FIG. 11 shows a sectional view of a winding device 10 with the energy storage means 50 from FIG. 9 and FIG. 10. The traction means 32 runs from the drive shaft element 21 via a pulley to the pulley 76, onwards to the second pulley 56, onwards to the first clutch shaft element 61, to the pulley 75, to the first pulley 55 and back to the drive shaft element 21.

The traction means 32 runs parallel to the first pulley 55 and to the second pulley 56, and this has the advantage that the length compensation is exactly equal on a displacement of the carriage 54.

FIG. 12 shows an offset sectional view of the winding device 10 from FIG. 11. The carriage 54 is connected with the carriage guide 53, both to the left and also to the right, in each case via two spring elements 52. As a result, on the one hand the restoring force of the spring elements 52 is increased, and on the other hand the carriage 50 can also move to the left if the drive shaft element 21 brakes, for example at the falling edge in FIG. 7. Preferably, damping elements 66, 67 are also provided which dampen the movement of the carriage 54 at desired end positions.

FIG. 13 shows a variant of the energy storage means 50 from FIG. 5. As in the energy storage means 50 from FIG. 11 and FIG. 12, spring elements 52 are provided in both relative directions of rotation. Thus, the energy storage means 50 can also have a supporting effect in the event of a braking by the drive shaft element, wherein a rotation of the second clutch shaft element 62 relative to the first clutch shaft element 61 in the direction 65 from a basic energetic state Z1 to an energy-charged state Z2' is possible, and subsequently once again a transition from the state Z2' to the basic state Z1. Damping elements 66, 67 are also provided.

In other words, the spring element 52 is configured, on a rotation of the first clutch shaft element 61 relative to the second clutch shaft element 62 in a first predetermined direction of rotation 64, to partially absorb potential energy in the form of spring energy, namely on a rotation from the state Z1 in the direction of the state Z2, and on a relative rotation in the second direction of rotation 65 opposite the first direction of rotation 64, to release the previously stored potential energy again, namely on a rotation from the state Z2 back in the direction of the state Z1.

In addition, the spring element 52 is configured, on a rotation of the first clutch shaft element 61 relative to the second clutch shaft element 62 in a predetermined direction of rotation 65, to partially absorb potential energy in the form of spring energy, namely on a rotation from the state Z1 in the direction of the state Z2', and on a relative rotation in the direction of rotation 64 opposite this direction of rotation 65, to release the previously stored potential energy again, namely on a rotation from the state Z2' back in the direction of the state Z1.

FIG. 14 shows a diagram showing the curve of the transmission ratio i over the time t upon acceleration using one of the illustrated energy storage means. The transmission ratio i=n_20/n_63 is considered, i.e. the ratio between the rotational speeds of the drive shaft 20 and the clutch shaft 63.

A value i0 shows the basic transmission ratio of the traction gear 30 if the energy storage means 50 remains unchanged. For example the rising edge from FIG. 7 begins at a time t0, and since the inert mass on the clutch shaft 63 cannot follow immediately, the energy storage means 50 performs a change of state from the state Z1 in the direction of the state Z2. The transmission ratio i is thereby increased over time until the energy storage means 50 has arrived at a state Z2 in which no further energy is stored. This is the case at the time t1.

The state of the energy storage means 50 then changes from the state Z2 back to the state Z1.

At the time t2, the energy storage means 50 has been depleted, and the transmission ratio i once again corresponds to the basic transmission ratio i0 of the traction gear 30.

By way of explanation, reference is always made to a movement between the first state Z1 and the second state Z2. However, one of the end states Z1, Z2 is not reached every time, and the amount of potential energy stored in the energy storage means depends on numerous factors, in particular on the acceleration of the drive shaft 20 and on the mass of the reel 90.

FIG. 15 shows a diagram showing the curve of the transmission ratio i over the time t upon braking by the drive shaft 20, using one of the illustrated energy storage means from FIG. 12 or FIG. 13. The transmission ratio i=n_20/n_63 is considered, i.e. the ratio between the rotational speeds of the drive shaft 20 and the clutch shaft 63.

A value i0 shows the basic transmission ratio of the traction gear 30 if the energy storage means 50 remains unchanged. For example, the rising edge from FIG. 7 begins at a time t0 and, since the rotating inert mass on the clutch shaft 63 cannot be braked immediately, the energy storage means 50 performs a change in state from the state Z1 in the direction of the state Z2'. The transmission ratio i is thereby lowered over time until the energy storage means 50 is in the state Z2' in which no further energy is stored. This is the case at the time t1.

The state of the energy storage means 50 then changes from the state Z2' back to the state Z1, wherein the transmission ratio i is increased in this region, since the clutch shaft 63 is additionally braked on conversion of the energy from the spring elements 52.

At the time t2, the energy storage means 50 has been depleted, and the transmission ratio i once again corresponds to the basic transmission ratio i0 of the traction gear 30.

FIG. 16 shows the region of the clutch shaft 63 in a section along the sectional line XV from FIG. 2.

A bolt 152 is fixed to the housing flange 150, for example through a screwed connection. The bolt 152 is indicated with dots in order to facilitate understanding. The output shaft 80 is guided in the bolt 152, and a pot 84 is attached non-rotatably at the left-hand end of the output shaft 80. The clutch shaft 63 is mounted rotatably on the output shaft 80 and connected non-rotatably with the second clutch shaft element 62, preferably being formed in a single piece with this. A clutch disc 85 is provided on the second clutch shaft element 62 which is configured to interact with the pot 84 in order so to enable a closing of the clutch 60 to form a frictional connection. The second clutch shaft element 62 is connected with the first clutch shaft element 61 via one or more bearings 162 and is in operative connection with the first clutch shaft element 61 via the spring elements 52. The energy storage means 50 comprises the first clutch shaft element 61, the second clutch shaft element 62 and the spring element 52, and it corresponds to the energy storage means from FIG. 5.

The traction means 32 is in contact with the first clutch shaft element 61 and can drive this. A clamping piece 160 is connected with the right-hand end of the output shaft 80, and an axial bearing 158 is arranged on the left-hand side of the clamping piece 160. A socket 156 sits on the bolt 152, wherein a thread 153 is provided between the bolt 152 and the socket 156. The pendulum 69 is connected non-rotatably with the socket 156, and as a result a rotation of the pendulum 69 leads to a relative rotation between the socket 156 and the bolt 152 and, via the thread 153, simultaneously to an axial displacement of the socket 156 relative to the bolt 152. If the socket 156 is moved to the right through the axial displacement, it presses against the axial bearing 158 and, via this, against the clamping piece 160. As a result, the output shaft 80 is shifted to the right, and this leads to a clamping between the pot 84 and the second clutch element 62 or the clutch disc 85. As a result, a frictional connection is created between the second clutch shaft element 62 and the output shaft 80, and a torque can be transmitted from the traction means 32 via the clutch 60 to the output shaft 80. If, in contrast, the socket 156 is moved to the left relative to the bolt 152, the pot 84 moves away from the clutch disc 85, and the clutch 60 is opened. In the exemplary embodiment, the thread has an axial displacement of approximately 1 mm on a rotation of the pendulum 69 by 90°; the clutch 60 thus only requires a small axial displacement of the pot 84 in order to change between the opened and closed states.

The illustrated advantageous exemplary embodiment allows a change in the pendulum position of the pendulum 69 to be translated directly into an opening or closing of the clutch 60. Naturally, it is for example also possible to use an electronic clutch 60 and to ascertain the position of the pendulum 69 via a sensor, in order to influence the clutch 60, depending on the determined value.

The configuration in which the bolt 152 is configured as a hollow shaft makes possible a compact structure. However, the output shaft 80 could for example also be continued to the left, and a simple disc clutch could be used.

Braking Device 200

FIG. 17 shows a braking device 200 for braking the output shaft 80 in a first state B1. The braking device 200 is, by way of example, configured as a web brake. The braking device 200 has a main body 210 which is mounted rotatably on a bearing point 212. A belt 214 is attached to the main body 210 which belt, in the exemplary embodiment, extends from the main body 210 around the pot 84 and back to the main body. The belt 214 thus forms a loop. If the main body 210 is rotated in a clockwise direction (see arrow 230) around the bearing point 212, the belt 214 is tensioned around the pot 84, and this leads to a braking through the friction between the pot 84 and the belt 214. If the main body 210 is then rotated back in an anticlockwise direction, the braking effect through friction is reduced, and the pot 84 and thus also the output shaft 80 connected with the pot 84 can rotate. In the exemplary embodiment, a force is applied to the main body 210 in the direction of the arrow 230 by a spring element 216, so that in the basic state a braking effect occurs. A reel 220 is attached to the main body 210, and the reel 220 is in contact with an eccentric 218. The pendulum 69 points substantially upwards, and in this position the eccentric 218 connected with the pendulum 69 presses the main body 210 in an anticlockwise direction, so that the braking device 210 is deactivated. The direction of the maximum leverage or distance of the eccentric from the axis of rotation is indicated by a line.

FIG. 18 shows the braking device 200 in a second state B2. The pendulum 69 has been rotated in an anticlockwise direction through an increased web tension, and as a result of the rotation of the pendulum 69 the eccentric 218 has also been rotated, so that the point of the maximum radius points away from the reel 220.

This rotation of the eccentric 218 makes possible a deflection of the main part 210 in a clockwise direction, and as a result a braking effect can be achieved through the braking device 200.

In the exemplary embodiment, a gear drive (not shown) with a transmission ratio of 1:2 is provided between the pendulum 69 and the eccentric 218, so that a deflection of the pendulum by 90 degrees causes a rotation of the eccentric 218 by 180 degrees.

Other braking devices, for example electronic braking devices with motors, can also be provided, and the configuration with the pendulum 69 can also be such that for example the pendulum 69 is configured eccentrically in its region facing the main body 210 and on a rotation from the state B1 into the state B2 the main part 210 moves in a clockwise direction in that it presses directly on the main part 210.

FIG. 19 shows four pendulum positions P1, P2, P3 and P4 of the pendulum 69. In the range between the pendulum positions P1 and P2, the clutch 60 is closed, and the reel 90 is driven and/or braked via the traction gear 30 and the drive shaft 20. At the pendulum position P2, the clutch 60 is opened.

In the range between the pendulum positions P2 and P3, the clutch 60 is opened, and the braking device 200 is not yet active. The reel 90 can thus rotate, and it is neither accelerated via the traction gear 30 nor braked via the traction gear 30, or through the braking device 200. Thus, if the label web is advanced by the labeler 12, the output shaft 80 is not driven by the drive shaft 20; instead, the pendulum 69 is moved in the direction of the pendulum position P2.

Between the pendulum positions P3 and P4, the clutch 60 is again opened, and the braking device 200 from FIG. 17 is active and brakes the reel 90. The braking of the reel 90 has in particular proved advantageous in tests with very wide and large reels 90. Furthermore, in the case of such reels, with long labels in particular it was found that the high rotational energy of the rotating reel could not be braked via the gear and the drive shaft, and as a result a lot of energy had to be converted into heat in the clutch. Also, a protracted accidental unreeling, due to insufficient braking, can lead to the pendulum 69 being deflected to its maximum extent and then tearing the carrier web 131 (FIG. 1). A further problem can occur if the carrier web 131 is so robust that the tension on the carrier web is transmitted through the winding device 10 via the drive roller of the labeler 12 up to the dispensing beak 141 (see FIG. 1), since this affects the precision of labelling.

The three-zone model shown in FIG. 19 makes possible a safe operation of the winding device 10.

Naturally, a wide range of variance and modifications is possible within the scope of the invention.

In the embodiments, a cyclic operation of the labeler 12 is shown in which the invention is particularly advantageous due to the high accelerations (positive and negative) which occur. However, the winding device 10 can also be used for a continuous operation in which the label web is not stopped between each dispensing action.

Instead of the pendulum 69, another measuring device can be used to ascertain the web tension of the carrier web 131. For example, web tension measuring devices can be used which use a deflection stamp to measure the deflecting force, or optical frequency meters which measure the vibration of the web which is dependent on the web tension.

The invention claimed is:

1. Winding device (10) for winding a carrier web (92) onto a reel (90), said winding device (10) having a drive shaft (20), a gear (30), a clutch shaft (63), an energy storage means (50), a clutch (60) and an output shaft (80), said gear (30) being configured, as a positive-engagement gear, to transmit a rotary movement of the drive shaft (20) to a first clutch shaft element (61) assigned to the clutch shaft (63), said clutch shaft (63) being connected via the clutch (60) with the output shaft (80) in order, selectively, to enable a transmission of torque between the clutch shaft (63) and the output shaft (80) or to prevent a transmission of torque between the clutch shaft (63) and the output shaft (80), said gear (30) having, at times when the energy storage means (50) is not effective, a first predetermined transmission ratio (i_0) between the drive shaft (20) and the clutch shaft (63), and said energy storage means (50) being configured to enable a storage of potential energy with simultaneous increase of the transmission ratio relative to the first predetermined transmission ratio, and to enable a release of the stored potential energy with simultaneous lowering of the transmission ratio relative to the first predetermined transmission ratio.

2. Winding device according to claim 1, wherein the energy storage means (50) is configured to enable a storage of potential energy with simultaneous lowering of the transmission ratio relative to the first predetermined transmission ratio, and then to enable a release of the stored potential energy with simultaneous increase of the transmission ratio relative to the first predetermined transmission ratio.

3. Winding device according to claim 1, wherein the gear is configured as a gear drive.

4. Winding device (10) according to claim 1, wherein the energy storage means (50) comprise the first clutch shaft element (61) and a second clutch shaft element (62) associated with the first clutch shaft element (61), said second clutch shaft element (62) being firmly connected to the clutch shaft (63), wherein the first clutch shaft element (61) and the second clutch shaft element (62) are arranged concentrically with the clutch shaft (63) and are rotatable relative to each other, wherein at least one spring element (52) is arranged between the first clutch shaft element (61) and the second clutch shaft element (62), said spring element (52) being configured, on a rotation of the first clutch shaft element (61) relative to the second clutch shaft element (62) in a first predetermined direction of rotation (64), at least partially to absorb potential energy in the form of spring energy, and on a relative rotation in a second direction of rotation (65) opposite to the first direction of rotation (64), at least partially to release the potential energy again.

5. Winding device according to claim 4, wherein a first damping element (66) is provided which is configured at least partially to damp a rotation of the first clutch shaft element (61) relative to the second clutch shaft element (62) in the second direction of rotation (65).

6. Winding device according to claim 4, wherein a second damping element (67) is provided, which is configured at least partially to damp a rotation of the first clutch shaft element (61) relative to the second clutch shaft element (62) in the first direction of rotation (64).

7. Winding device according to claim 4, wherein a first stop (68) is provided in order to limit a relative rotation of the first clutch shaft element (61) relative to the second clutch shaft element (62) in the first direction of rotation (64).

8. Winding device according to claim 7, wherein the stop (68) is arranged at least partially in the spring element (52)

in order to effect a guidance of the spring element (52).

9. Winding device according to claim 3, wherein the gear (30) is configured as a positive-engagement traction gear (30), said traction gear (30) having a traction means (32), said traction means (32) interacting with the drive shaft (20) and with the first clutch shaft element (61) in order to enable a transmission of torque from the drive shaft (20) to the clutch shaft (63).

10. Winding device according to claim 9, wherein the traction gear (30) is configured as a toothed belt gear with a toothed belt as traction means (32), and wherein the first clutch shaft element (61) is configured as a belt pulley.

11. Winding device according to claim 9, wherein the traction gear (30) is configured as a chain gear with a chain as traction means (32), and wherein the first clutch shaft element (61) is configured as a sprocket.

12. Winding device according to claim 9, wherein the energy storage means (50) comprises a carriage guide (53) and a carriage (54), said carriage (54) being displaceable relative to the carriage guide (53), wherein at least one spring element (52) is arranged between the carriage (54) and the carriage guide (53), and said carriage (54) having at least one first pulley (55), said winding device defining a first partial path (33A) for the traction means (32) between the drive shaft (20) and the first clutch shaft element (61) and a second partial path (33B) between the first clutch shaft element (61) and the drive shaft (20), and wherein the first pulley (55) is, in the first partial path (33A), in contact with the traction means (32), so that a displacement of the carriage (54) results in a shortening or lengthening of the first partial path (33A), depending on the direction of displacement (57, 58), and said energy storage means (50) is configured to enable an absorption of energy in that the first partial path (33A) is changed such that the transmission ratio is increased relative to the first predetermined transmission ratio through this change in the first partial path (33A) and potential energy is thereby stored in the spring element (52), and to enable a release of the stored energy in that the first partial path (33A) is changed such that the transmission ratio is lowered relative to the first predetermined transmission ratio through this change in the first partial path (33A) and the potential energy stored in the spring element (52) is thereby released.

13. Winding device according to claim 12, wherein the energy storage means is configured to enable an absorption of energy, in that the first partial path (33A) is changed such that the transmission ratio is lowered relative to the first predetermined transmission ratio through this change in the first partial path (33A) and potential energy is thereby stored in said spring element (52), and to enable a release of the stored energy, in that the first partial path (33A) is changed such that the transmission ratio is increased relative to the first predetermined transmission ratio through this change in the first partial path (33A), and potential energy stored in the spring element (52) is thereby released.

14. Winding device according to claim 12, wherein the carriage (54) has a second pulley (56), said second pulley (56) being, in the second partial path (33B), in contact with the traction means (32) in order to effect a compensation in length between the first partial path (33A) and the second partial path (33B).

15. Winding device according to claim 12, wherein a damping element (66, 67) is provided at at least one end position of the carriage (54) which is configured to damp the movement of the carriage (54) towards a first end position, wherein damping elements (66, 67) are preferably provided at both end positions of the carriage (54).

16. Winding device according to claim 15, wherein at least one end position of the carriage (54) is defined by a stop (68), preferably both end positions.

17. Winding device according to claim 15, having a pendulum (69), said pendulum (69) being able to assume any of a plurality of pendulum positions, and wherein the clutch (60) is configured to influence the connection between the output shaft (80) and the clutch shaft (63), as a function of an instaneous position of said pendulum.

18. Winding device according to claim 17, wherein the pendulum has a web guide (70) for guiding a web (131), and wherein the pendulum position is dependent upon the tension of the web (131).

19. Winding device according to claim 1, further comprising a braking device (200), said braking device (200) being configured to enable a controllable braking of the output shaft (80).

20. Winding device according to claim 19, having a pendulum (69), said pendulum (69) being able to assume any of a plurality of pendulum positions, wherein the braking device (200) is configured to influence the controllable braking of the output shaft (80) as a function of an instantaneous position of said pendulum (69).

21. Winding device according to claim 19, which is configured, depending on the web tension, in a first range of the web tension, to keep the clutch (60) closed, at the transition from the first range into a second range, said second range being associated with a higher web tension than the first range, to open the clutch, and at the transition from the second range into a third range, said third range being associated with a higher web tension than the second range, to activate the braking device (200).

22. In combination, a labelling device (12)

having a drive (14) for movement of a label web (130) for the dispensing of labels (132), and a winding device (10) having a drive shaft (20), a gear (30), a clutch shaft (63), an energy storage means (50), a clutch (60) and an output shaft (80), said gear (30) being configured, as a positive-engagement gear, to transmit a rotary movement of the drive shaft (20) to a first clutch shaft element (61) assigned to the clutch shaft (63), said clutch shaft (63) being connected via the clutch (60) with the output shaft (80) in order, selectively, to enable a transmission of torque between the clutch shaft (63) and the output shaft (80) or to prevent a transmission of torque between the clutch shaft (63) and the output shaft (80), said gear (30) having, at times when the energy storage means (50) is not effective, a first predetermined transmission ratio (i_0) between the drive shaft (20) and the clutch shaft (63), and said energy storage means (50) being configured to enable a storage of potential energy with simultaneous increase of the transmission ratio relative to the first predetermined transmission ratio, and to enable a release of the stored potential energy with simultaneous lowering of the transmission ratio relative to the first predetermined transmission ratio; and wherein said drive (14) is configured also to drive the drive shaft (20) for the winding device (10).

23. Winding device according to claim 5, wherein a second damping element (67) is provided which is configured to at least partially to damp a rotation, in the first direction of rotation, of the first clutch shaft element (61) relative to the second clutch shaft element (62).

24. Winding device according to claim 11, wherein the energy storage means (50) comprises a carriage guide (53) and a carriage (54), said carriage (54) being displaceable relative to the carriage guide (53), wherein at least one spring element (52) is arranged between the carriage (54) and the carriage guide (53), and said carriage (54) having at least one first pulley (55), said winding device defining a first partial path (33A) for the traction means (32) between the drive shaft (20) and the first clutch shaft element (61) and a second partial path (33B) between the first clutch shaft element (61) and the drive shaft (20), and wherein the first pulley (55) is, in the first partial path (33A), in contact with the traction means (32), so that a displacement of the carriage (54) results in a shortening or lengthening of the first partial path (33A), depending on the direction of displacement (57, 58), and said energy storage means (50) is configured to enable an absorption of energy in that the first partial path (33A) is changed such that the transmission ratio is increased relative to the first predetermined transmission ratio through this change in the first partial path (33A) and potential energy is thereby stored in the spring element (52), and to enable a release of the stored energy in that the first partial path (33A) is changed such that the transmission ratio is lowered relative to the first predetermined transmission ratio through this change in the first partial path (33A), and the potential energy stored in the spring element (52) is thereby released.

* * * * *